US009919835B2

(12) United States Patent
Brisendine et al.

(10) Patent No.: US 9,919,835 B2
(45) Date of Patent: Mar. 20, 2018

(54) MULTI-PURPOSE TRANSPORT AND FLOORING STRUCTURES, AND ASSOCIATED METHODS OF MANUFACTURE

(71) Applicant: Good Works Studio, Inc, Houston, TX (US)

(72) Inventors: Sam Arthur Brisendine, Houston, TX (US); Scott Austin Key, Houston, TX (US)

(73) Assignee: Good Works Studio, Inc., Houston, TX (US)

( * ) Notice: Subject to any disclaimer, the term of this patent is extended or adjusted under 35 U.S.C. 154(b) by 0 days.

(21) Appl. No.: 14/965,735

(22) Filed: Dec. 10, 2015

(65) Prior Publication Data

US 2016/0090209 A1 Mar. 31, 2016

Related U.S. Application Data

(63) Continuation-in-part of application No. 14/298,783, filed on Jun. 6, 2014, now Pat. No. 9,228,361.
(Continued)

(51) Int. Cl.
*B65D 19/18* (2006.01)
*B65D 19/00* (2006.01)
(Continued)

(52) U.S. Cl.
CPC ..... *B65D 19/18* (2013.01); *B65D 19/0018* (2013.01); *B65D 19/38* (2013.01);
(Continued)

(58) Field of Classification Search
CPC .... B65D 19/0018; B65D 19/18; B65D 19/38; B65D 81/36; B65D 81/361;
(Continued)

(56) References Cited

U.S. PATENT DOCUMENTS 2,377,211 A * 5/1945 Cocken, Jr. ..... E04F 15/06 404/40
3,056,476 A * 10/1962 Fischer ..... E04B 9/0478 52/480
(Continued)

OTHER PUBLICATIONS

International Search Report with Written Opinion corresponding to International Patent Application No. PCT/US2014/041371, dated Oct. 29, 2014, 15 pages.

*Primary Examiner* — James M Ference
(74) *Attorney, Agent, or Firm* — Lathrop Gage LLP

(57) ABSTRACT

A monolithic interlocking tile, manufacturing method, and covering are disclosed. A closed-cell foam material is injected into a mold to form a monolithic structure having a first surface, a second surface offset and opposite the first surface, the first surface including a first lip located at two adjacent sides of the structure with a plurality of shaped protrusions, and the second surface including a second lip located at two other adjacent sides of the structure and forming a plurality of shaped apertures matching in number and shape with the plurality of protrusions; and a recess formed in the second lip and forming a hole for receiving a fastener to secure the monolithic structure to a supporting structure. Multiple monolithic interlocking tiles are interlocked together to form the covering for a floor, wall, ceiling, or roof.

22 Claims, 35 Drawing Sheets

Related U.S. Application Data

(60) Provisional application No. 61/832,000, filed on Jun. 6, 2013.

(51) Int. Cl.
*B65D 19/38* (2006.01)
*B65D 81/36* (2006.01)
*E04F 15/024* (2006.01)

(52) U.S. Cl.
CPC ..... *B65D 81/36* (2013.01); *B65D 81/361* (2013.01); *B65D 2519/00019* (2013.01); *B65D 2519/00024* (2013.01); *B65D 2519/00029* (2013.01); *B65D 2519/00034* (2013.01); *B65D 2519/00054* (2013.01); *B65D 2519/00059* (2013.01); *B65D 2519/00064* (2013.01); *B65D 2519/00069* (2013.01); *B65D 2519/0084* (2013.01); *B65D 2519/00273* (2013.01); *B65D 2519/00288* (2013.01); *B65D 2519/00318* (2013.01); *B65D 2519/00338* (2013.01); *B65D 2519/00407* (2013.01); *B65D 2519/00567* (2013.01); *B65D 2519/00746* (2013.01); *B65D 2519/00835* (2013.01); *E04F 15/02411* (2013.01); *E04F 2201/0594* (2013.01)

(58) Field of Classification Search
CPC ..... B65D 2519/00019; B65D 2519/00024; B65D 2519/00029; B65D 2519/00034; B65D 2519/00054; B65D 2519/00059; B65D 2519/00064; B65D 2519/00069; B65D 2519/00273; B65D 2519/00288; B65D 2519/00318; B65D 2519/00338; B65D 2519/00407; B65D 2519/00567; B65D 2519/00746; B65D 2519/00835; B65D 2519/0084; E04F 15/02411; E04F 2201/0594
See application file for complete search history.

(56) References Cited

U.S. PATENT DOCUMENTS 3,077,426 A * 2/1963 Johnston ..... B29C 43/021 112/410
3,568,390 A 3/1971 Swensen et al.
3,650,224 A 3/1972 Petix et al.
4,470,227 A 9/1984 Bigelow, Jr. et al.
4,622,792 A 11/1986 Betts
4,843,781 A * 7/1989 Chase, III ..... E04F 15/02417 52/792.1
4,871,063 A 10/1989 Kumbier
5,050,362 A * 9/1991 Tal ..... E04C 2/543 404/41
5,052,307 A 10/1991 Morrison
5,107,652 A * 4/1992 Sosa ..... E02D 29/025 160/135
5,434,355 A 7/1995 Sho
5,497,593 A * 3/1996 Riesberg ..... E04B 5/12 403/232.1
5,562,047 A 10/1996 Forney et al.
5,758,467 A 6/1998 Snear et al.
5,879,777 A 3/1999 Shipley
5,888,612 A 3/1999 Needham et al.
5,907,934 A * 6/1999 Austin ..... E04F 15/10 404/34
5,950,378 A * 9/1999 Council ..... E01C 13/045 52/177
5,950,546 A 9/1999 Brown et al.
5,971,655 A * 10/1999 Shirakawa ..... E01C 5/005 404/34
5,992,106 A * 11/1999 Carling ..... E01C 5/20 52/177
6,029,583 A 2/2000 LeTrudet
6,085,668 A 7/2000 Kanki
6,101,955 A 8/2000 Salce
6,234,087 B1 5/2001 Brown
6,467,224 B1 * 10/2002 Bertolini ..... E01C 5/22 404/35
6,511,257 B1 * 1/2003 Seaux ..... E01C 9/086 404/34
6,519,902 B1 * 2/2003 Scissom ..... E04F 15/02458 52/126.4
6,526,705 B1 * 3/2003 MacDonald ..... E04F 15/02 428/157
6,649,110 B1 * 11/2003 Seaux ..... B29C 39/10 249/176
6,685,388 B2 * 2/2004 Webster ..... E01C 5/20 403/408.1
6,751,912 B2 * 6/2004 Stegner ..... E01C 5/20 52/177
6,802,159 B1 * 10/2004 Kotler ..... E01C 5/20 404/35
6,976,436 B1 12/2005 Sugihara et al.
7,303,800 B2 12/2007 Rogers
7,331,147 B2 * 2/2008 Kalisiak ..... E01C 5/005 52/177
7,331,174 B2 2/2008 Kalisiak et al.
7,340,865 B2 * 3/2008 Vanderhoef ..... E04F 15/105 52/177
7,413,374 B2 * 8/2008 Rogers ..... E01C 9/086 404/35
7,487,622 B2 * 2/2009 Wang ..... E04F 13/0862 52/177
7,757,449 B2 * 7/2010 Portoles Ibanez ..... E04F 15/02016 404/35
7,793,471 B2 * 9/2010 Hill ..... B32B 3/10 428/33
8,266,849 B2 9/2012 Bravo et al.
2002/0088380 A1 7/2002 Hale
2002/0195134 A1 12/2002 Fenech
2003/0019403 A1 1/2003 Gruber et al.
2004/0005430 A1 * 1/2004 Rogers ..... B32B 3/02 428/44
2004/0226242 A1 * 11/2004 Moller, Jr. ..... E04F 15/105 52/384
2006/0070314 A1 * 4/2006 Jenkins ..... E01C 13/045 52/177
2006/0096187 A1 5/2006 Perkowski et al.
2006/0096508 A1 5/2006 Herring
2006/0260976 A1 * 11/2006 Apps ..... B65D 19/18 206/600
2006/0266713 A1 * 11/2006 Gearhart ..... B29C 66/71 210/767
2006/0272252 A1 * 12/2006 Moller, Jr. ..... E01C 5/20 52/384
2007/0102243 A1 * 5/2007 Ruminski ..... E01C 5/20 182/222
2007/0175132 A1 8/2007 Spransy et al.
2007/0223993 A1 * 9/2007 Peterson, Jr. ..... E01C 5/005 403/364
2008/0072514 A1 3/2008 Barlow
2008/0127593 A1 * 6/2008 Janesky ..... E04F 15/18 52/581
2008/0210140 A1 * 9/2008 Valentinsson ..... B65D 19/0014 108/57.25
2009/0178367 A1 * 7/2009 Barlow ..... B44C 1/28 52/745.13
2009/0320722 A1 12/2009 Korbonski
2011/0120037 A1 * 5/2011 Barlow ..... B44C 1/28 52/309.1
2012/0240506 A1 * 9/2012 Zhu ..... E04F 15/02 52/588.1
2012/0243949 A1 * 9/2012 Schneider ..... E02D 5/80 405/302.7

* cited by examiner

MULTI-PURPOSE TRANSPORT AND FLOORING STRUCTURES, AND ASSOCIATED METHODS OF MANUFACTURE

RELATED APPLICATIONS

This application is a Continuation-in-Part of U.S. patent application Ser. No. 14/298,783, titled "Multi-Purpose Transport and Flooring Structures, and Associated Methods of Manufacture", filed Jun. 6, 2014, which claims priority to U.S. Provisional Patent Application No. 61/832,000, filed Jun. 6, 2013. Each of these applications is incorporated herein by reference.

FIELD OF THE INVENTION

The present disclosure relates to flooring and to shipping, and more particularly to the combination of multiple shipping pallets or pallet caps for additional purposes, such as formation of an expandable, raised flooring system.

BACKGROUND

When transporting goods via rail, airplane, trailer truck, or by cargo ship, packaging, containment and support of the goods is of paramount importance. Pallets are often used to support goods, alone or within additional transport structures, such as boxes or crates, during transport. Pallets themselves are transport-specific goods, manufactured specifically for use during transport.

The cost of pallets is assumed by the shipper, because the pallets themselves are generally not sold as goods upon arrival. Pallets also increase fuel cost of the shipper, as they add weight to cargo and thus increase the amount of fuel needed for transport. Furthermore, this additional weight can at times reduce the overall amount of goods that may be transported by vehicles; a point especially true of aircraft and watercraft transport. Finally, in their use of forest resources, pallets carry a significant environmental burden. Despite efforts to repair and re-use wooden pallets, they are often disposed of after use, thus requiring additional resources to create more pallets, and increasing the environmental costs of the transport industry.

In summary, as a single-purpose shipping good, conventional pallets have a higher than desirable environmental cost and increase shipper-assumed costs and fuel costs, while reducing the total amount of saleable goods that may be transported as cargo.

SUMMARY

In one embodiment, an interlocking tile includes a monolithic structure having a first surface, and a second surface offset and opposite the first surface. The first surface includes a first lip located at two adjacent sides of the structure, and the second surface includes a second lip located at two other adjacent sides of the structure. The first lip has a plurality of shaped protrusions and the second lip forms a plurality of shaped apertures matching in number and shape with the plurality of protrusions. A recess is formed in the second lip and forms a hole for receiving a fastener to secure the monolithic structure to a supporting structure.

In another embodiment, a method manufactures a monolithic interlocking tile by injecting a closed-cell foam material into a mold to form a monolithic structure having a first surface, a second surface offset and opposite the first surface, the first surface including a first lip located at two adjacent sides of the structure with a plurality of shaped protrusions, and the second surface including a second lip located at two other adjacent sides of the structure and forming a plurality of shaped apertures matching in number and shape with the plurality of protrusions; and a recess formed in the second lip and forming a hole for receiving a fastener to secure the monolithic structure to a supporting structure.

In another embodiment, an interlocking tile covering includes a first monolithic structure and a second monolithic structure. The first monolithic structure has a first surface and a second surface offset and opposite the first surface. The first surface includes a first lip located at two adjacent sides of the first structure. The second surface includes a second lip located at two other adjacent sides of the first structure. The first lip has a first plurality of shaped protrusions and the second lip forms a first plurality of shaped apertures matching in number and shape with the first plurality of protrusions. A first recess is formed in the second lip and forms a first hole for receiving a first fastener to secure the first monolithic structure to a supporting structure. The second monolithic structure has a third surface and a fourth surface offset and opposite the third surface. The third surface includes a third lip located at two adjacent sides of the second structure. The fourth surface includes a fourth lip located at two other adjacent sides of the second structure. The third lip has a second plurality of shaped protrusions and the fourth lip forms a second plurality of shaped apertures matching in number and shape with the second plurality of protrusions. A second recess is formed in the fourth lip and forms a second hole for receiving a second fastener to secure the second monolithic structure to the supporting structure. Each of the second plurality of protrusions mates with a corresponding one of the first plurality of shaped apertures.

DETAILED DESCRIPTION

Figure 1:
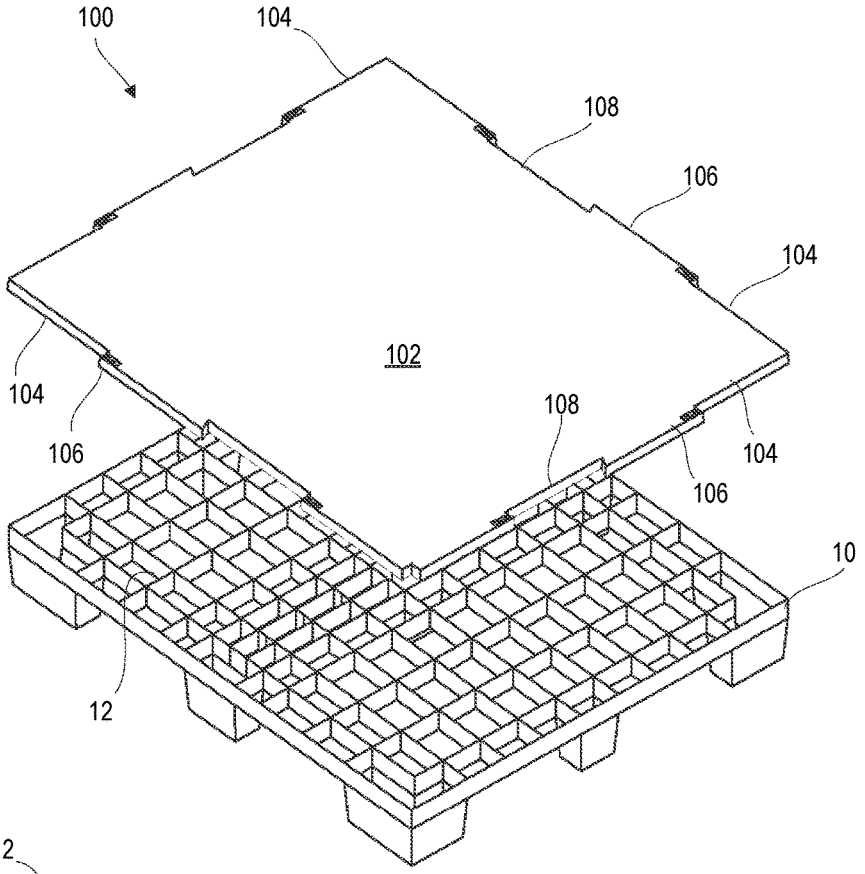
FIG. 1 is a top perspective view of a pallet cap for covering and attaching with a pallet, according to an embodiment.
Figure 2:
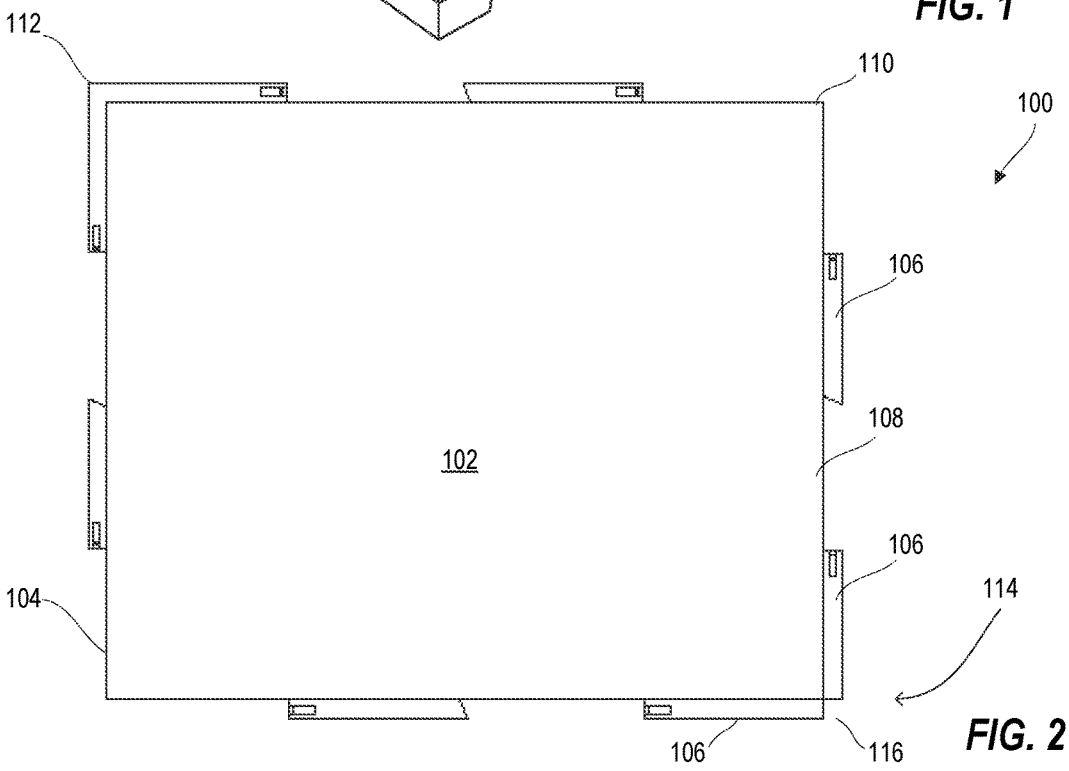
FIG. 2 is a top view of the pallet cap of FIG. 1.

FIG. 1 illustrates alignment of a multipurpose transport structure 100 with a pallet 10. Pallet 10 may be a pallet used in transport, or a discarded or found pallet. FIG. 2 is a top view of transport structure 100. For purposes of the following discussion, FIGS. 1 and 2 are best viewed together.

Multipurpose transport structure 100 is also referred to hereinafter as pallet cap 100, panel 100, and tile 100. Pallet cap 100 has a flat top surface 102 and four edges 104. Each edge 104 features one or more edge extensions generally designated as 106, and more specifically herein below. An edge notch 108 may be formed between two edge extensions 106 along the same edge 104. For clarity of illustration, not all extensions 106 and notches 108 are labeled. Edges 104 that are normal to one another join at a corner 110; whereas edge extensions 106 that are normal to one another join at an extended corner 112. A notched corner 114 is formed where two edge extensions 106 meet at a corner of pallet cap 100, separated by a corner notch 116. In one aspect, edge extensions 106 of notched corner 114 are in-plane with one another. Alternately, notched corner 114 may be formed of an upper edge extension 118 and a lower, plate-like extension 120 (described below and with reference to FIGS. 5-7), of two upper extensions 118 or of two lower, plate-like extensions 120.

Pallet cap 100 may be made from plastic and/or composite materials, or alternately from wood, metal or other suitably strong and rigid material. Pallet cap 100 is designed to fit over a top surface 12 of shipping pallet 10, thus providing a continuously flat surface. In transport, pallet cap 100 and pallet 10 reinforce one another, thus providing additional strength for supporting cargo. The flat surface of pallet cap 100 also facilitates walking atop shipping pallets, for example when cargo is transferred or rearranged manually, rather than by machine.

In the field, for example at a refugee camp, pallet cap 100 may be placed atop a shipping pallet 10, for example, one left at the camp with cargo or found at or near the camp, to provide a raised platform or flooring unit. Edges 104, extensions 106, 118 and 120 and notches 108 of pallet cap 100 are shaped and configured to fit puzzle-like with complementary features (i.e., extensions 106, 118, 120, edges 104 and/or notches 108 as arrangement dictates) of adjacent pallet caps 100, such that an expandable and customizable raised floor may be assembled from pallets 10 and pallet caps 100. Pallet caps 100 thus allow for appropriation of wasted pallets in the field into an expandable, raised flooring system using a fraction of the material conventionally required to build a raised floor.

Figure 3:
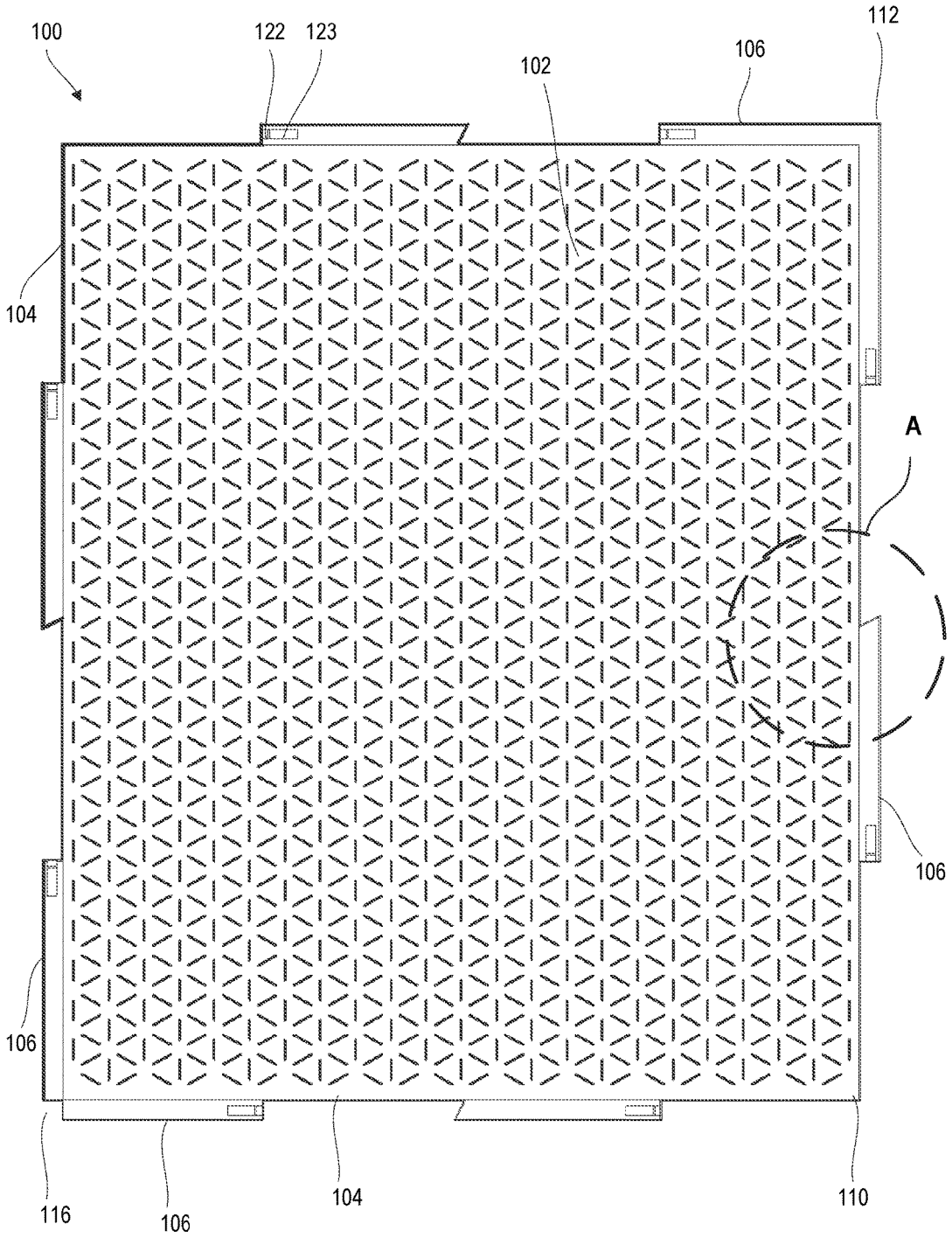
FIG. 3 is a top view of the pallet cap of FIGS. 1 and 2, detailing a textured top surface, according to an embodiment.

As shown in FIG. 3, top surface 102 of pallet cap 100 may be a non-slip surface. Non-slip surface 102 may be formed with texture (e.g., provided by extrusions and/or indentations), for example during molding or forming of pallet cap 100, or a non-skid treatment may be applied to surface 102 after pallet cap 100 is formed. Non-skid treatments include, but are not limited to, a textured or high-friction spray coating, an adhesive sheet or sheets, a surface treatment to roughen top surface 102 and a raised or recessed pattern formed within top surface 102, for example via injection molding, via structural foam injection molding, during thermoforming (e.g., vacuum forming), or during rotocasting or rotational molding. Peripheral edges of top surface 102 and edge extensions 106, 118 and 120 may be left un-treated to facilitate joining of pallet caps 100.

Figure 4:
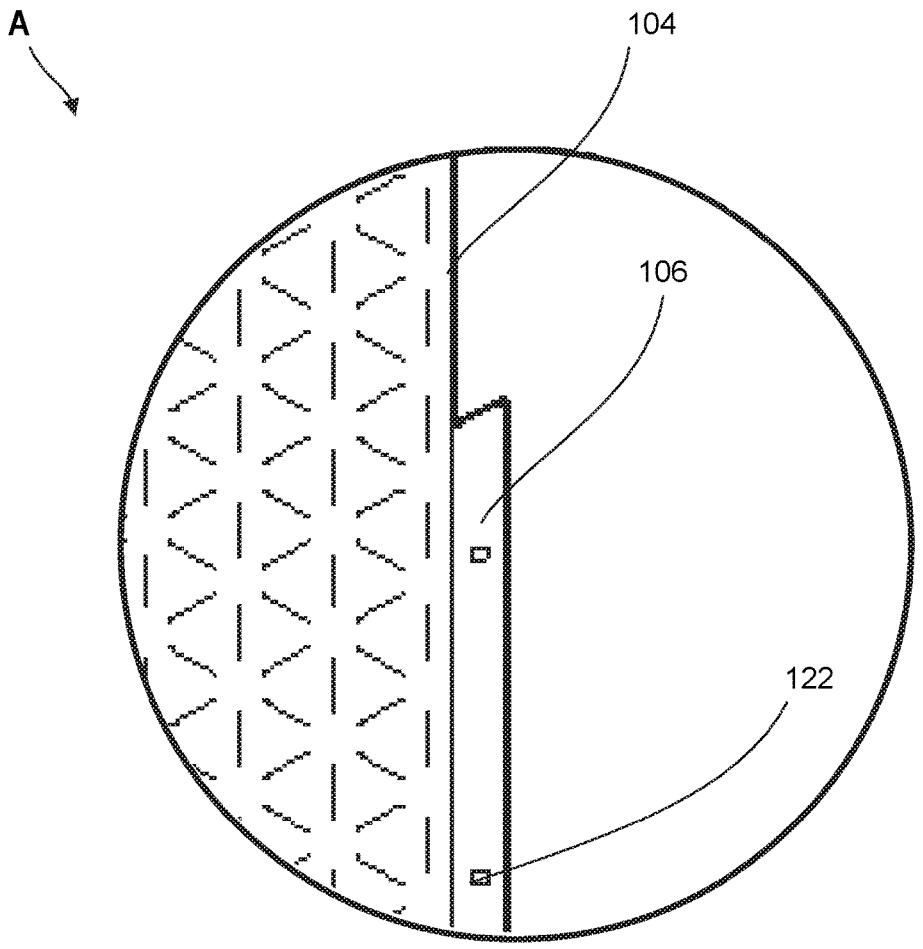
FIG. 4 is an enlarged view of a portion of a connecting edge of the pallet cap of FIG. 3.

FIG. 4 is an enlarged view of area A, FIG. 3. One or more apertures 122 may be formed through extension 106, for example within a slot 123. As described below, apertures 122 facilitate connection of pallet cap 100 with an adjacent pallet cap.

Figure 5:
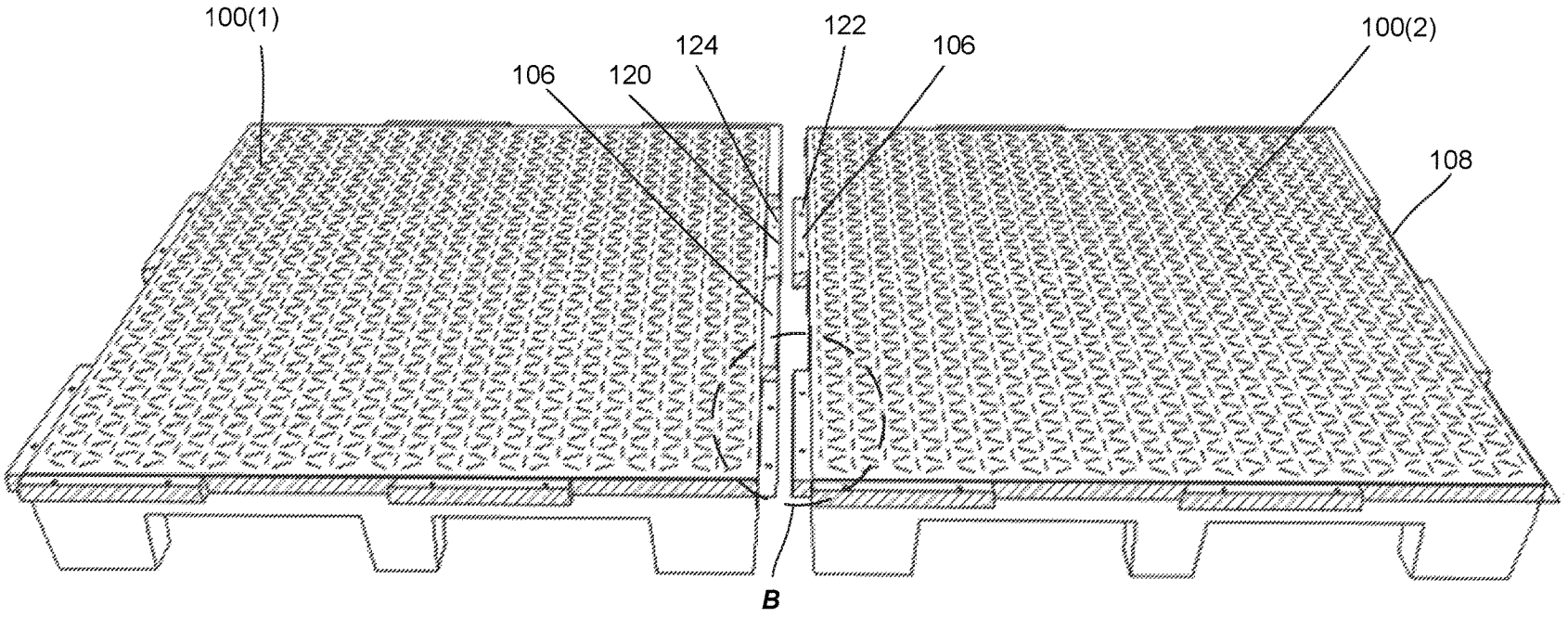
FIG. 5 is a perspective view of two pallet caps aligned prior to joining by their connecting edges, according to an embodiment.
Figure 6:
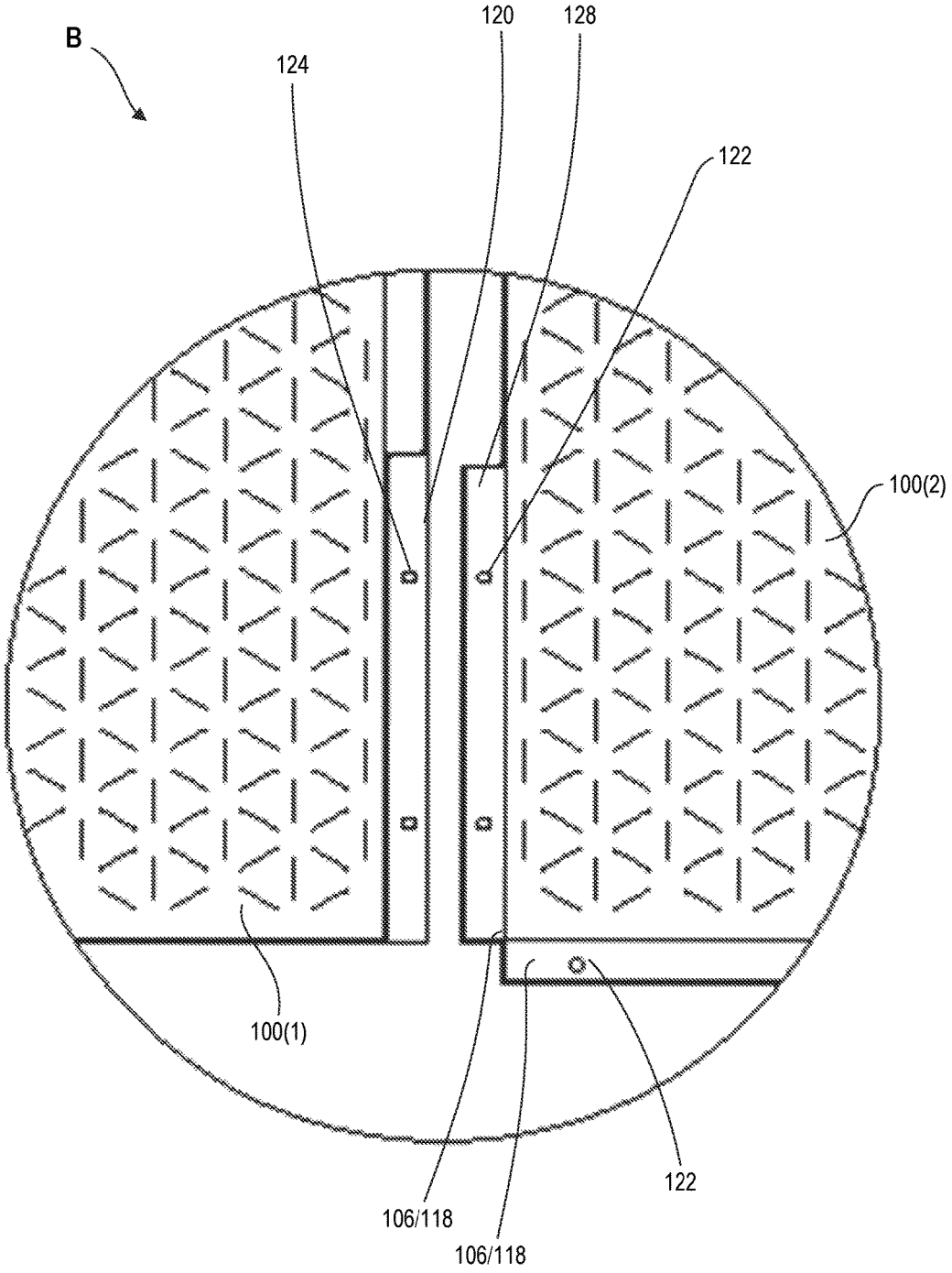
FIG. 6 is an enlarged view illustrating alignment of the pallet caps of FIG. 5, prior to joining.

FIG. 5 shows two adjacent pallet caps 100(1) and 100(2). FIG. 6 is an enlarged view of area B, FIG. 5, illustrating alignment of joining features of pallet caps 100(1) and 100(2). FIGS. 5 and 6 are best considered together with the following description.

Lower plate-like edge extensions 120 between extensions 106/118 may be formed as extensions from a lower portion of a notch 108, and sized such that upon joining with an extension 106/118 of an adjoining pallet cap 100, a smooth and even surface results at the junction of the pallet caps. FIGS. 5 and 6 respectively show edge extensions 106 and upper edge extensions 118 of pallet cap 100(2) fitted atop lower plate-like edge extensions 120 (referred to hereinafter as lower edge plates 120) of pallet cap 100(1). Edge extensions 106 of pallet cap 100(1) fit between notches 108 of pallet cap 100(2). Lower edge plates 120 offer additional support, reinforcement and connections between pallet caps 100. For example, as indicated in FIG. 6 and as further shown in FIGS. 7-9, apertures 122 of edge extensions 106 align with apertures 124 of lower edge plates 120 when pallet caps 100(1) and 100(2) are placed together. A fastener 20 (shown as a zip tie; however, fastener 20 may alternately be another wire-, string- or cord-like fastener, a bolt, a screw, a nail, or a stake) may then be placed through apertures 122 and 124 to secure adjacent pallet caps (i.e., 100(1) and 100(2)) together.

Figure 7:
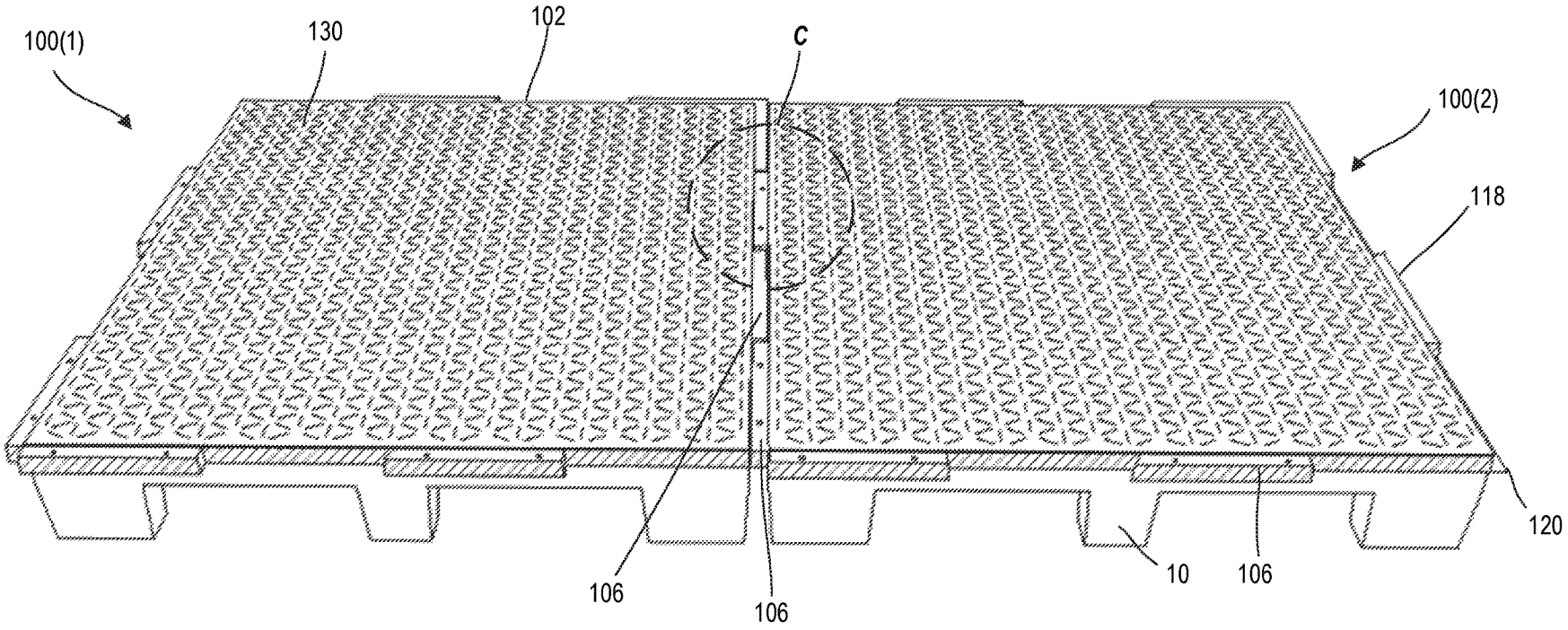
FIG. 7 is a perspective view showing the pallet caps of FIGS. 5 and 6, joined together.
Figure 8:
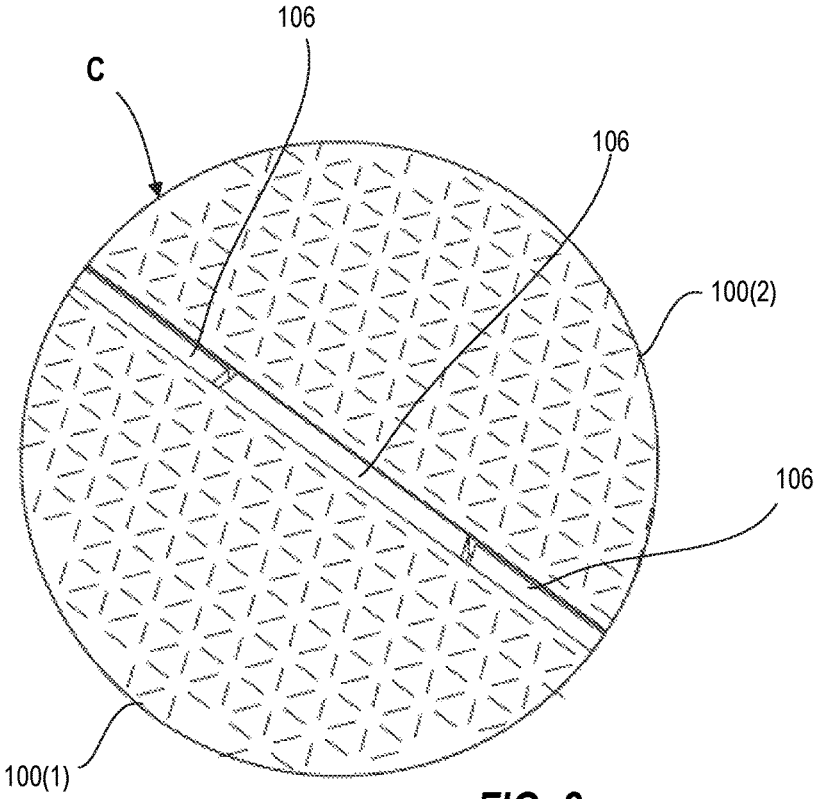
FIG. 8 is an enlarged view illustrating alignment of the pallet caps of FIG. 7 when joined together.
Figure 9:
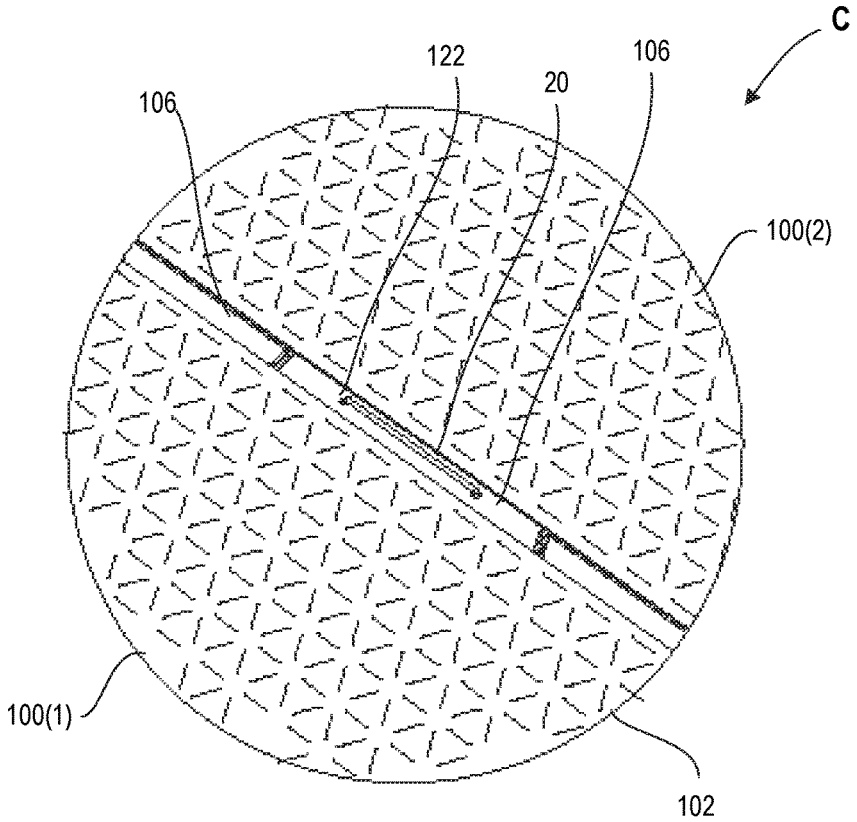
FIG. 9 is an enlarged view illustrating attachment of the pallet caps of FIGS. 5-8 with a strip fastener, according to an embodiment.
Figure 10:
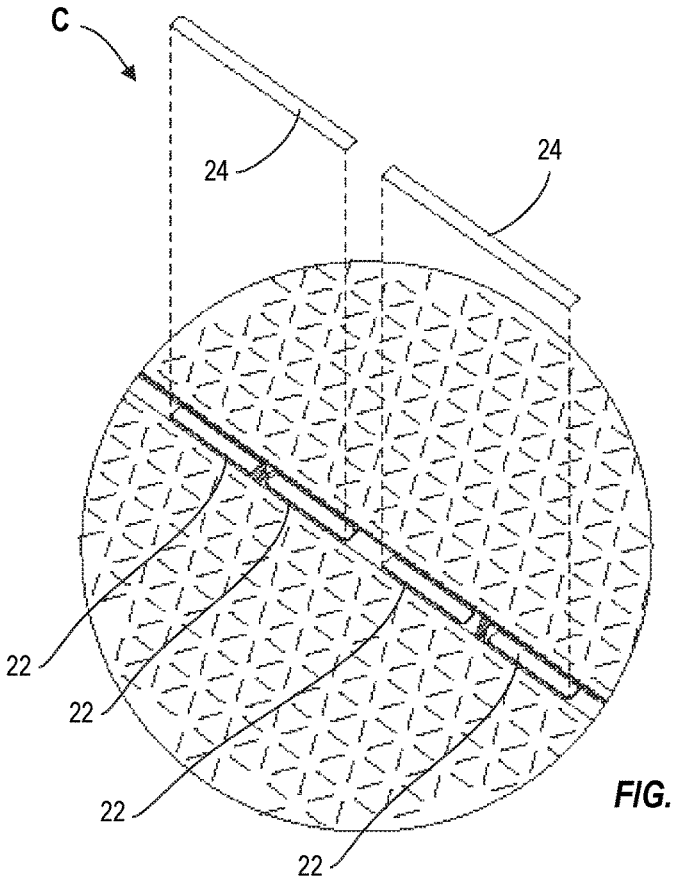
FIG. 10 is an enlarged view showing a hook-and-loop fastener arrangement applied to the pallet caps of FIGS. 5-8, according to an embodiment.
Figure 11:
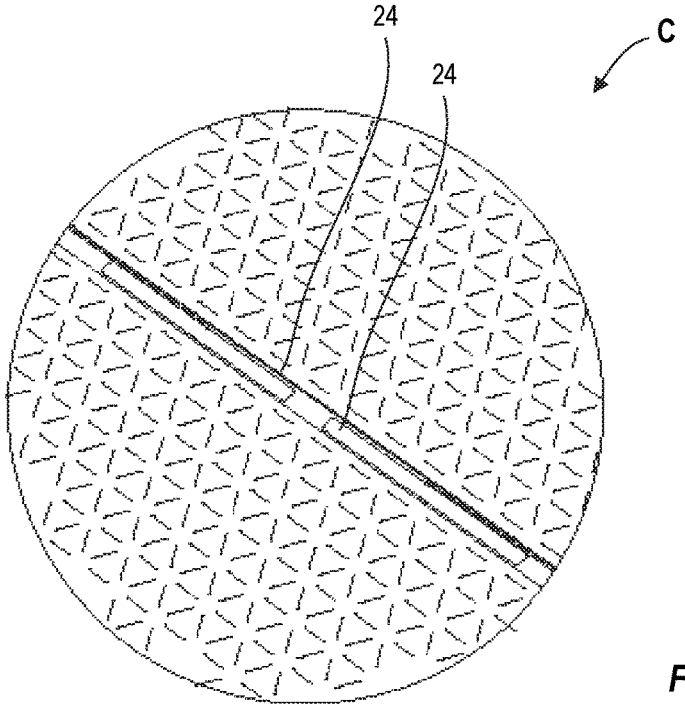
FIG. 11 shows a complimentary strip of hook-and-loop fastener applied over the arrangement of FIG. 10.

FIG. 7 shows pallet caps 100(1) and 100(2) fully fitted together. FIGS. 8-11 are enlarged views of an area C of FIG. 7. These figures are best viewed together with the following description.

Once pallet caps 100(1) and 100(2) are fitted snugly together (FIGS. 7 and 8), a zip tie 20 (FIG. 9) may be threaded through apertures 122 and 124 and secured beneath pallet caps 100(1) and 100)2), so as to be non-interfering with a person walking, lying or otherwise using top surfaces 102 of the joined pallet caps. Alternately or additionally, strips of hook-and-loop fastener 22, such as that manufactured and sold under the trademark Velcro®, are applied at adjacent ends of extensions 106 of pallet caps 100(1) and 100(2), or at other adjacent points between caps 100(1) and 100(2). See FIG. 10. A complementary strip of hook and loop fastener 24 (FIG. 11) sized to contact both adjacent strips 22 may be applied over strips 22 and pressure applied to join strip 24 with strips 22 and further secure pallet caps 100(1) and 100(2) together.

Figure 12:
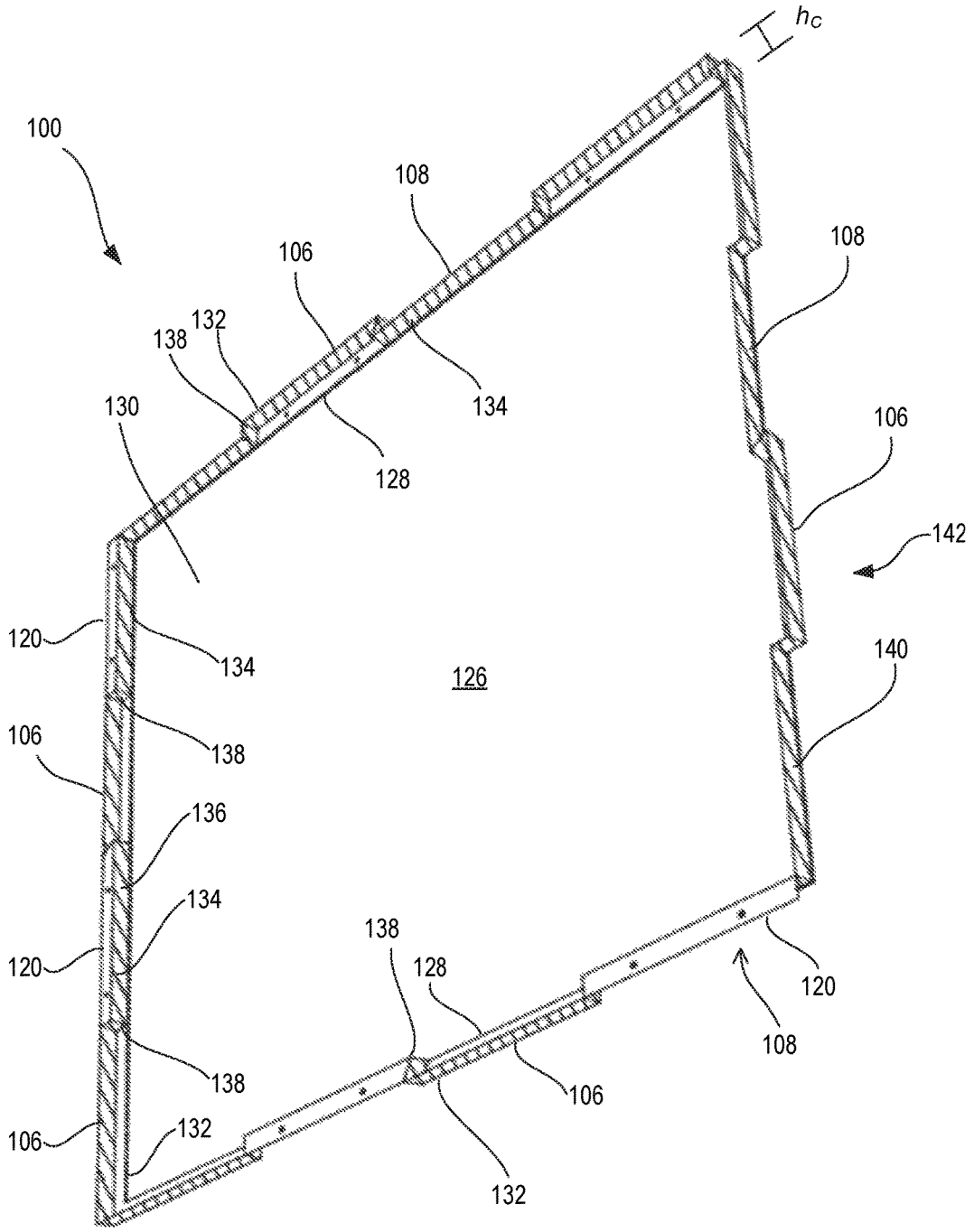
FIG. 12 is a bottom perspective view of the pallet cap of FIG. 1.

FIG. 12 illustrates an underside or bottom side 126 of pallet cap 100. As shown, edge notches 108, including lower edge plates 120, form a cap thickness or height $h_C$ of about 1 to 4 inches, with a clearance of about ½ inch to 2 inches between bottom side 126 and a supporting surface. Length and width of pallet cap 100 are sized to fit over conventional pallets, for example, over 40 inch by 48 inch pallets. Pallet cap 100 may be slightly oversized, to allow for expansion and contraction in various weather and humidity conditions and to include edge extensions 106 outside the perimeter of the pallet.

Height $h_C$ may be consistent throughout pallet cap 100, or may be a maximum thickness of edge extensions 106 and/or notches 108.

As shown in FIG. 12, edge extensions 106 may be formed of a horizontal plate 128 extending outward from top surface 102 of a reinforced platform 130 (see, e.g., FIG. 7 for this surface) and a downwardly extending outer wall 132 extending from a distal end of horizontal plate 128 and forming an obtuse angle with a bottom surface of horizontal plate 128. Lower edge plates 120 may extend horizontally from a rear retaining wall 134, which extends downward from platform 130 at a platform-to-wall junction 136. Lower edge plates 120 may be bordered laterally by sidewalls 138, which separate and define lower edge plates 120 and edge extensions 106. One or more sides of pallet cap 100 may include simple and notches 108 (without horizontal lower edge plates 120). See, for example, side 142.

Rear retaining walls 134 and platform 130/bottom surface 126 form an enclosure for shipping pallets 10 (see FIG. 1), to prevent the pallets from slipping laterally from beneath pallet cap 100. Horizontal plates 128 of edge extensions 106 may have a length $l_E$ of about one inch beyond platform 130 (and therefore, notches 108 have a depth/lower edge plates 120 have a width of about one inch), to provide space for interconnection of additional pallet caps 100 via corresponding notches 108 and edge extensions 106. A height $h_E$ of edge extensions 106 is equivalent to height $h_W$ of rear retaining wall 134, thus providing an expandable flooring system made from pallet caps 100 to have a level top surface when adjacent pallet caps 100 connect with edge extensions 106, within notches 108, with downwardly extending outer walls 132 of edge extensions 106 abutting rear retaining walls 134 and resting atop lower edge plates 120 of edge notches 108. See FIGS. 16 and 17 for length $l_E$, height $h_E$ and height $h_W$.

In one aspect, rear retaining walls 134 and outer walls 132 form an obtuse angle with platform 130 (i.e., with bottom surface 126 of platform 130). Sidewalls 138 therefore taper outward from top surface 102. The actual angle (draft angle) between walls 132, 134 and 138 and bottom surface 126 is chosen such that multiple pallet caps 100 can stack together for easy storage and transport.

Figure 14:
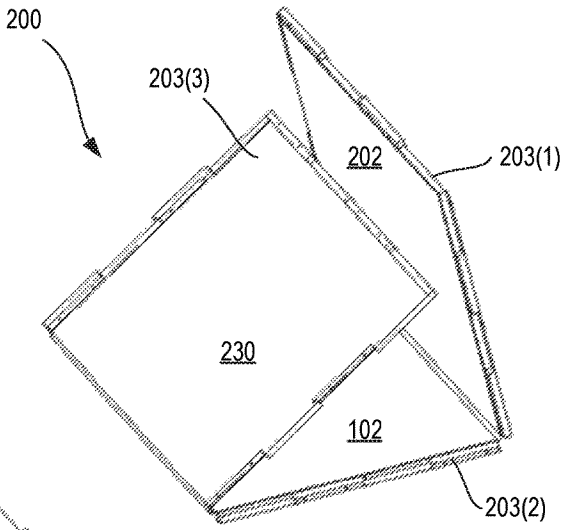
FIG. 14 is a top, perspective view showing the fold-out pallet cap of FIG. 13 in a partially unfolded configuration.
Figure 13:
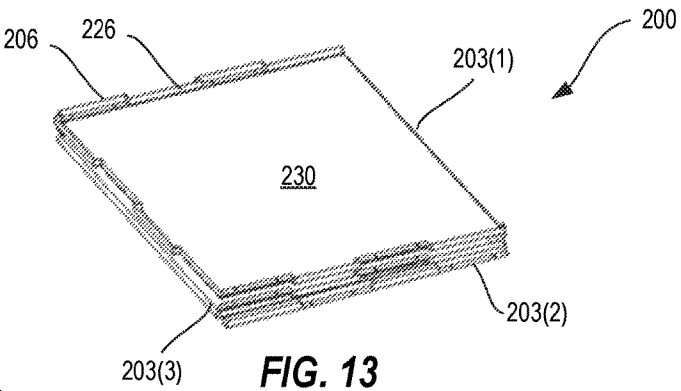
FIG. 13 is a top, perspective view of a fold-out pallet cap in a folded configuration, according to an embodiment.
Figure 15:
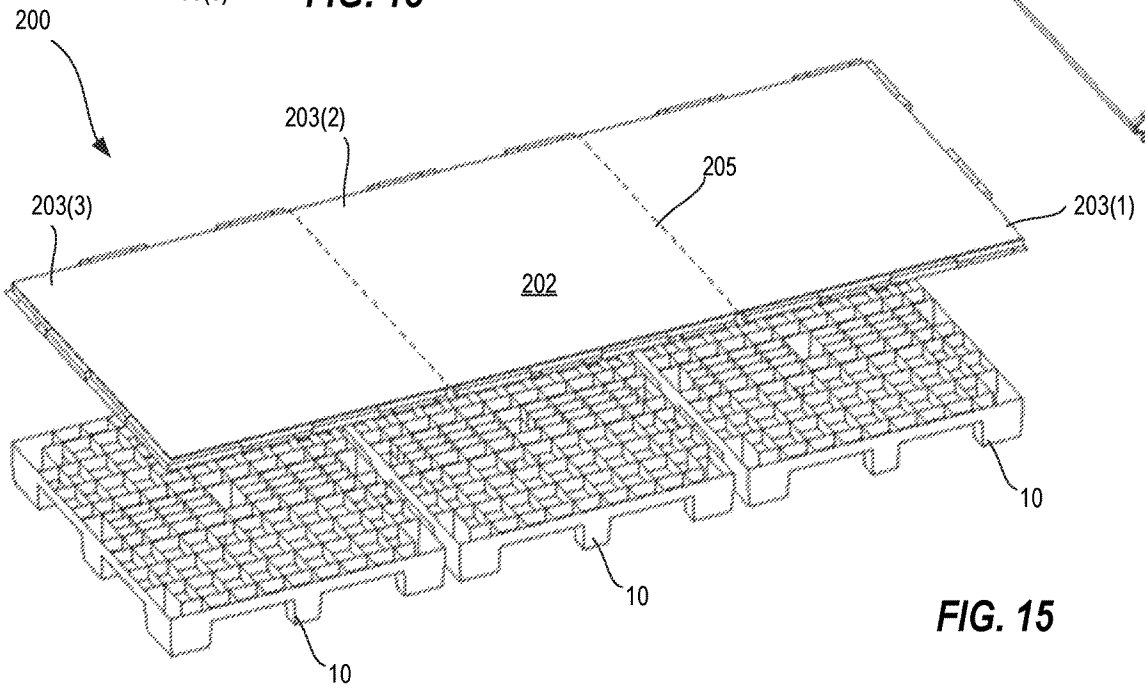
FIG. 15 is a top, perspective view of the fold-out pallet cap of FIG. 13 in a fully unfolded configuration, positioned with a series of pallets, according to an embodiment.

FIGS. 13-15 illustrate a foldable pallet cap 200. Pallet cap 200 includes interconnected tiles 203(1)-203(3) that fold along hinges or seams 205. Tiles 203 may be sized such that each fits over one shipping pallet 10; however, alternate sizes are within the scope hereof. Pallet cap 200 may advantageously be customized to fit one to multiple shipping pallets or other supporting structures, by selectively unfolding tiles 203. For example, pallet cap 200 may be fully folded, as shown in FIG. 13, and fitted atop a single shipping pallet (i.e., pallet 10) during transport, and then unfolded at its destination to cover three or more shipping pallets or supporting structures. It will be appreciated that although pallet cap 200 is illustrated with three tiles 203, more or less tiles 203 and alternate positions of tiles 203 are within the scope hereof. Tiles 203 need not form a linear/rectangular structure when unfolded, but may form a square, a cross or other shapes. For example, a six-tile pallet cap 200 includes four linearly-arranged tiles 203 with two tiles 203 extending from opposing open sides of one tile 203, and may be unfolded and re-folded and fixed to form a storage crate or box.

Each tile 203 of pallet cap 200 may include features of pallet cap 100, described above. Although not all such features are called out in FIGS. 13-15, upper surfaces 202, bottom surfaces 230, edge extensions 206 and lower edge plates 226 (see plates 120, above) are illustrated. These and other features of pallet cap 200 tiles 203 may be understood by reviewing the description of like features 102, 126, 106, 120, etc., above.

Figure 16:
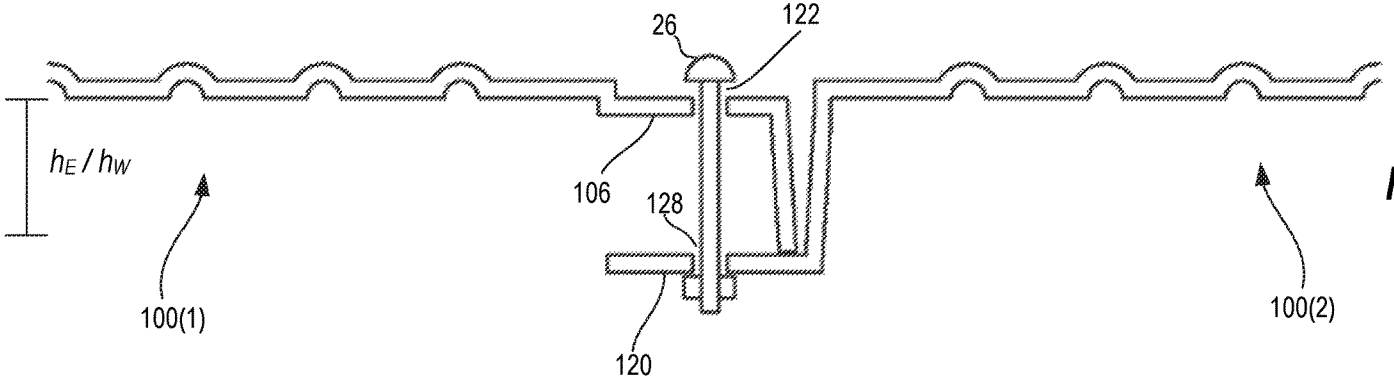
FIG. 16 is a cross-sectional view illustrating fixation of two adjacent pallet caps by a bolt, according to an embodiment.
Figure 17:
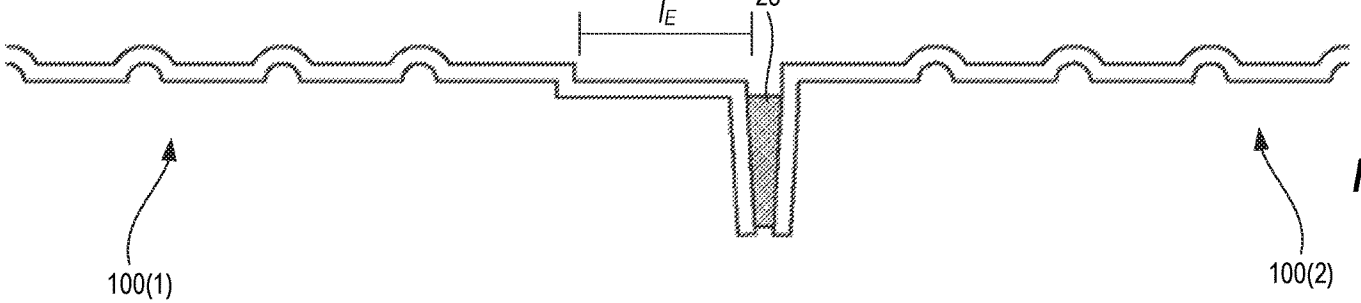
FIG. 17 is a cross-sectional view illustrating fixation of two adjacent pallet caps by a joining material, according to an embodiment.
Figure 18:
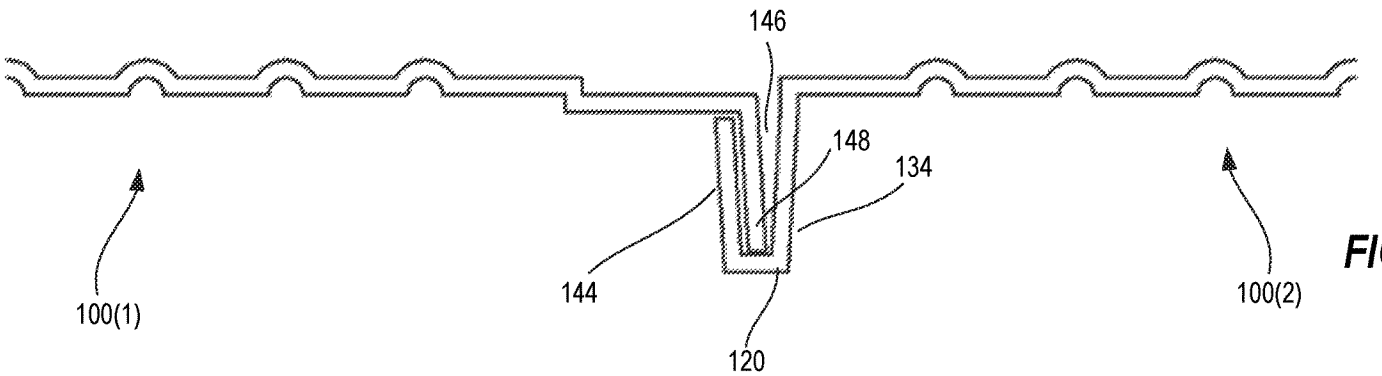
FIG. 18 is a cross-sectional view illustrating fixation of two adjacent pallet caps by complementary features of the caps, according to an embodiment.

FIGS. 16-18 depict alternate arrangements for fastening adjacent pallet caps 100/200 together. A screw or bolt 26 may be positioned through aligned apertures 122 (of edge extension 106/206) and 124 (of lower edge plate 120/226) of adjacent pallet caps 100/200, as shown in FIG. 16. Alternately or additionally, pallet caps 100/200 may be joined at adjacent edges by an adhesive 28 (FIG. 17). It will be appreciated that when used in the field, adhesive 28 may be made partly or entirely of natural materials, including mixtures of tree sap and mud. Pallet caps 100/200 may also or alternately be joined via complementary lock-and-key features. For example, as shown in FIG. 18, lower edge plate 120 forms a distal extension 144, and a trough 146 between distal extension 144 and rear wall 134. Trough 146 is sized to accept a lateral extension 148 of adjacent pallet cap 100(1). It will be appreciated that alternate lock-and-key features, such as various male and female members, slide connections, hooks or pins and apertures and the like are also within the scope hereof. It will also be appreciated that pallet caps 200 may incorporate or be joined by similar features.

Figure 19:
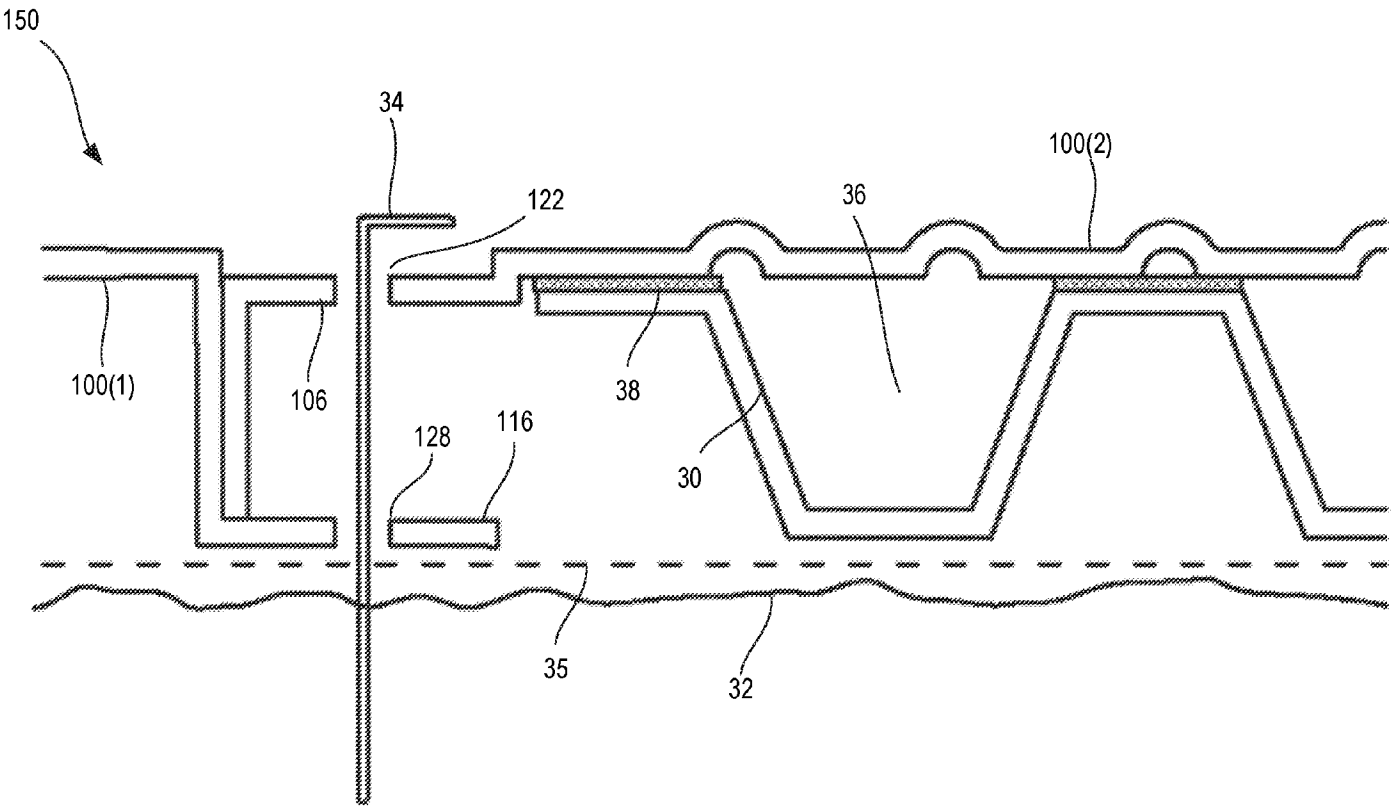
FIG. 19 is a cross-sectional view showing adjacent and connected pallet caps overlying a supporting/insulating structure, according to an embodiment.

FIG. 19 is a partial, cross-sectional view of a raised flooring system 150 including pallet caps 100 over a supporting structure 30 and ground surface 32. Supporting structure 30 may be a shipping pallet (i.e., pallet 10), hard cell foam, corrugated metal or other substantially raised and strong fill, or may be selected from or combined with supporting and fill materials described herein below. A stake 34 is placed through apertures 122 and 124 of edge extension 106 and lower edge plate 120, respectively, and into ground 32. Plastic sheeting 35 may alternately be placed beneath supporting structure 30, to reduce transfer of moisture from ground 32 to supporting structure 30 and thereby prevent or reduce molding or other moisture-induced decay. Supporting structure 30 insulates flooring system 150 by raising system 150 off ground 32 and by providing insulating sub-floor airspaces 36. Adhesive 38 may optionally be used to further secure pallet caps 100 with supporting structure 30. Adhesives include conventional tapes or glues, along with naturally occurring materials such as mud or tree sap. It will be appreciated that raised flooring system 150 may include any number of pallet caps 100, with stakes 34 selectively placed to best secure flooring system 150 to ground 32. It will also be appreciated that pallet caps 200 may substitute for or combine with caps 100 in flooring system 150.

Figure 20:
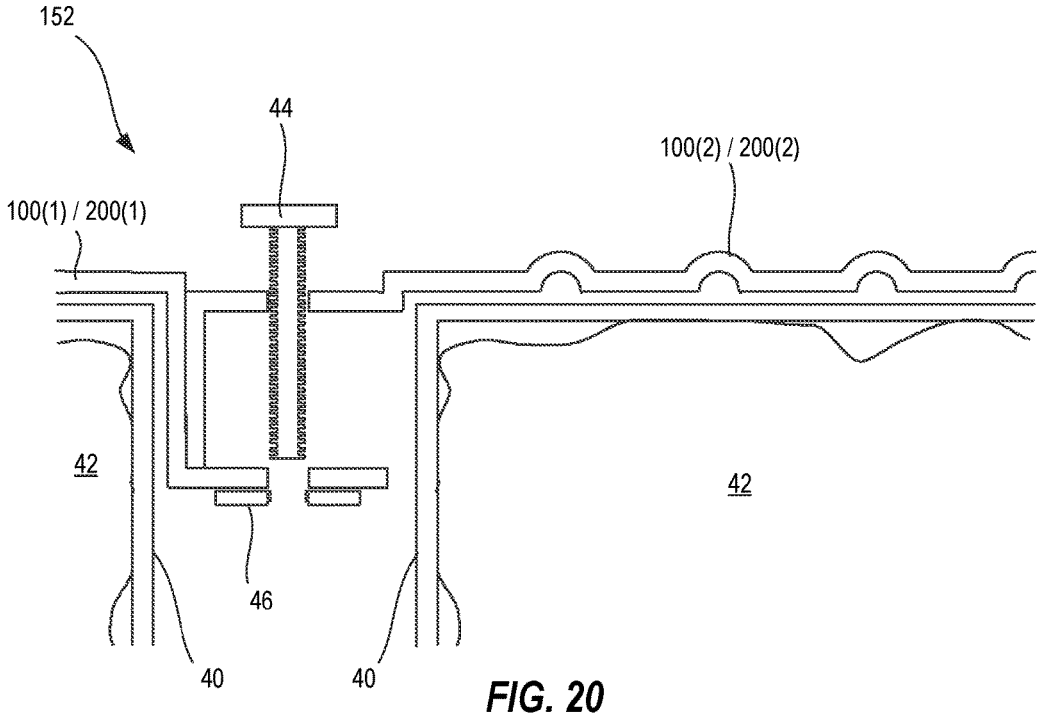
FIG. 20 is a cross-sectional view showing adjacent and connected pallet caps overlying a supporting/insulating structure upon a ground surface, according to an embodiment.

FIG. 20 is a cross-sectional view of a raised flooring system 152, illustrating joining of two pallet caps 100/200 over supporting structures 40 filled with debris 42. In one aspect, structures 40 are large boxes, for example, cardboard boxes, filled with dirt, plastic debris, cloth debris, paper waste or other refuse. Debris 42 both provides support to structures 36 and caps 100/200 and insulates flooring system 152. Pallet caps 100/200 may be joined together with bolts or screws 44 and nuts 46. Stakes 34 (not shown) may also be incorporated as necessary to stake system 152 to a ground surface.

Figure 21:
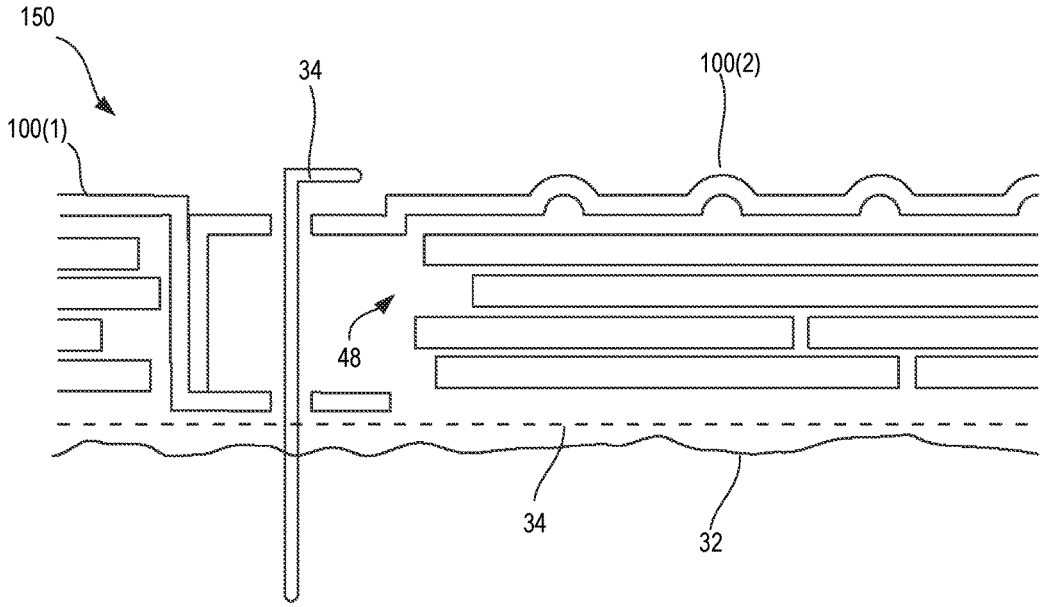
FIG. 21 is a cross-sectional view showing adjacent and connected pallet caps overlying boxes on a ground surface, according to an embodiment.

FIG. 21 is a cross-sectional view of raised flooring system 150 (FIG. 19), featuring an alternate multi-unit supporting structure 48. Multi-unit supporting structure 48 may include filled cardboard boxes, bricks or wood, among other options.

Figure 22:
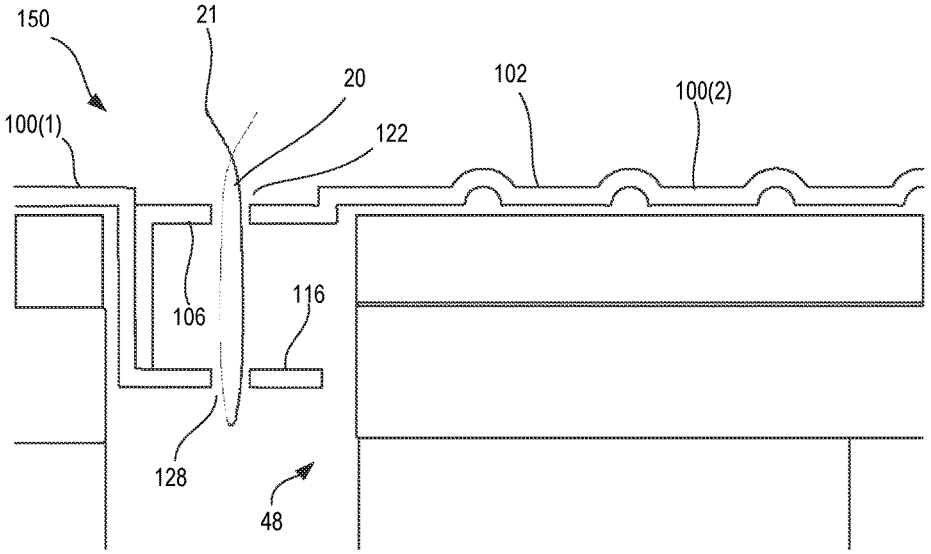
FIG. 22 is a cross-sectional view showing adjacent pallet caps connected by a tie fastener and overlying a supporting/insulating structure, according to an embodiment.

FIG. 22 illustrates joining of pallet caps 100/200 over multi-unit supporting structure 48 via zip tie 20. As described above, an end 21 of zip tie 20 is fed through a first aperture 122 of edge extension 106 and down and through a first aperture 124 of lower edge plate 120, when pallet caps 100 are aligned for connection. End 21 is then fed up through a second aperture 124 of lower edge plate 120 and a second aperture 122 of edge extension 106, and secured. Although FIG. 22 illustrates securing of zip tie 20 at or above top surfaces 102 of pallet caps 100, it will be appreciated that pallet caps 100 may alternately be joined with zip tie 20 beneath lower edge plate 120, for example at an easily-accessible edge of raised flooring system 150, or when pallet caps 100 are to be joined first and then laid over multi-unit supporting structure 48.

Figure 23:
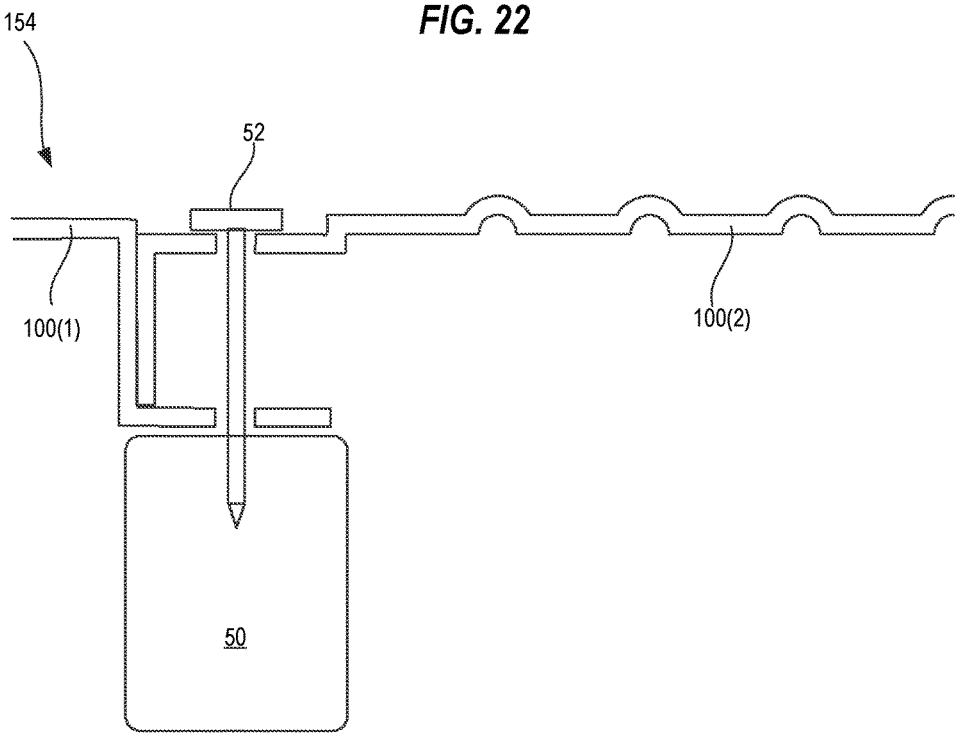
FIG. 23 is a cross-sectional view illustrating attachment of connected pallet caps to lumber, according to an embodiment.

FIG. 23 illustrates joining and securing pallet caps 100 to lumber 50, for example a structural post, board or framing member. Lumber 50 may for example be a vertically-oriented portion of a frame for a housing unit, and as such, pallet caps 100 may form an expandable and customizable structural wall 154. Structural wall 154 is shown secured with lumber 50 via a stake 52; however, other fasteners, such as those described below, may also be used.

Figure 24:
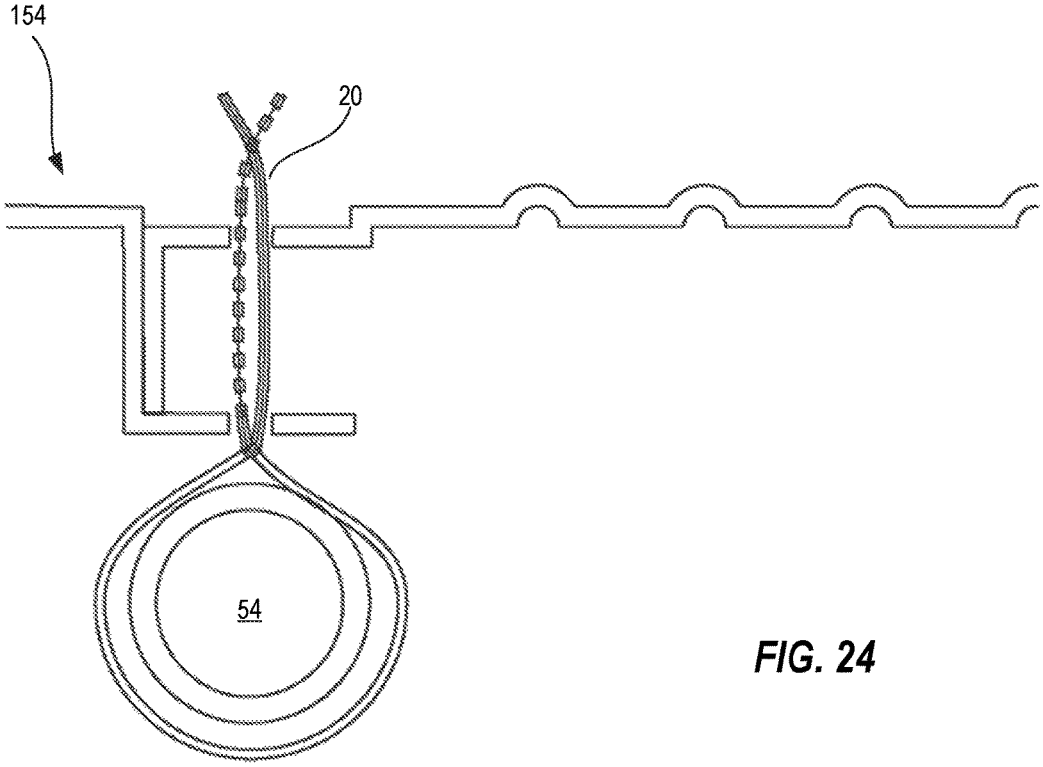
FIG. 24 is a cross-sectional view illustrating attachment of connected pallet caps to a pole, according to an embodiment.
Figure 25:
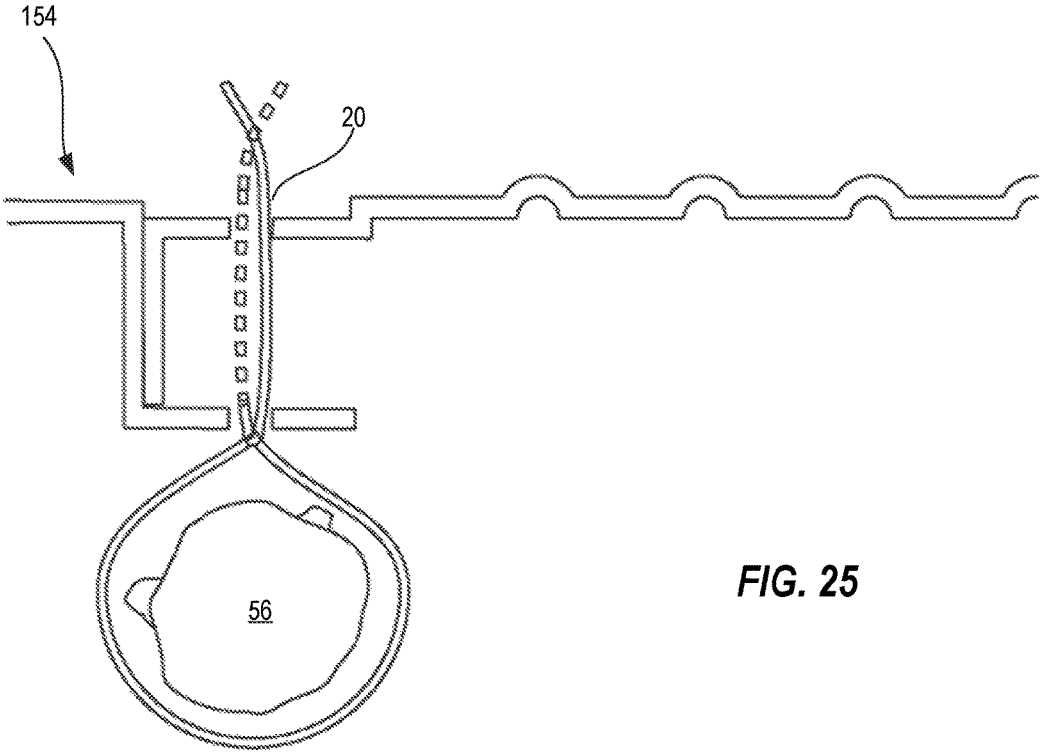
FIG. 25 is a cross-sectional view illustrating attachment of connected pallet caps to timber, according to an embodiment.

FIGS. 24 and 25 show structural wall 154 respectively attached with a pole 54 and timber 56 (for example, a tree trunk or limb), by zip tie 20. Other cord-, wire-, or rope-like fasteners may alternately be used.

Figure 26:
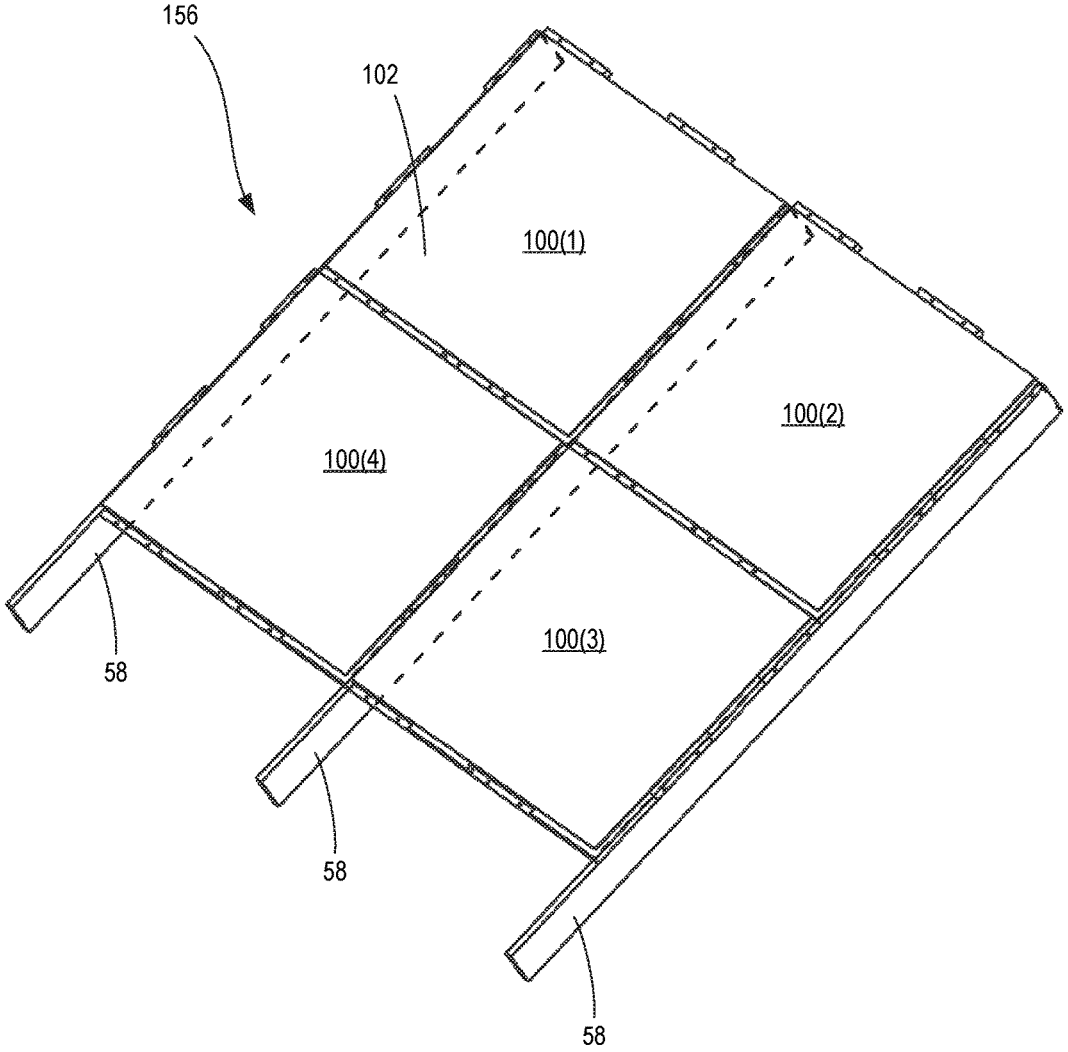
FIG. 26 is a perspective view illustrating attachment of a plurality of pallet caps to structural members of a roof, according to an embodiment.

FIG. 26 is a top, perspective view showing an expandable roofing or ceiling system 156 attached with frame members 58. Frame members 58 are shown as lumber forming the partial skeleton of a roof; however, it will be appreciated that roofing system 156 may alternately be attached with rougher support members, for example, tree limbs. Pallet caps 100(1)-100(4) connect with one another and with frame members 58 as previously illustrated and described. That is, caps 100 may connect with one another via adhesive, zip ties, bolts, screws or nails, hook and loop fasteners and/or lock and key features. Caps 100 are secured with frame members 58 via screws, bolts, nails, zip ties or other fasteners. Outer surfaces 102 of pallet caps 100 are shown facing outwards (i.e., atop the roof), in order to provide a smooth roof surface to allow precipitation to run off without being caught within pallet caps 100.

Figure 27:
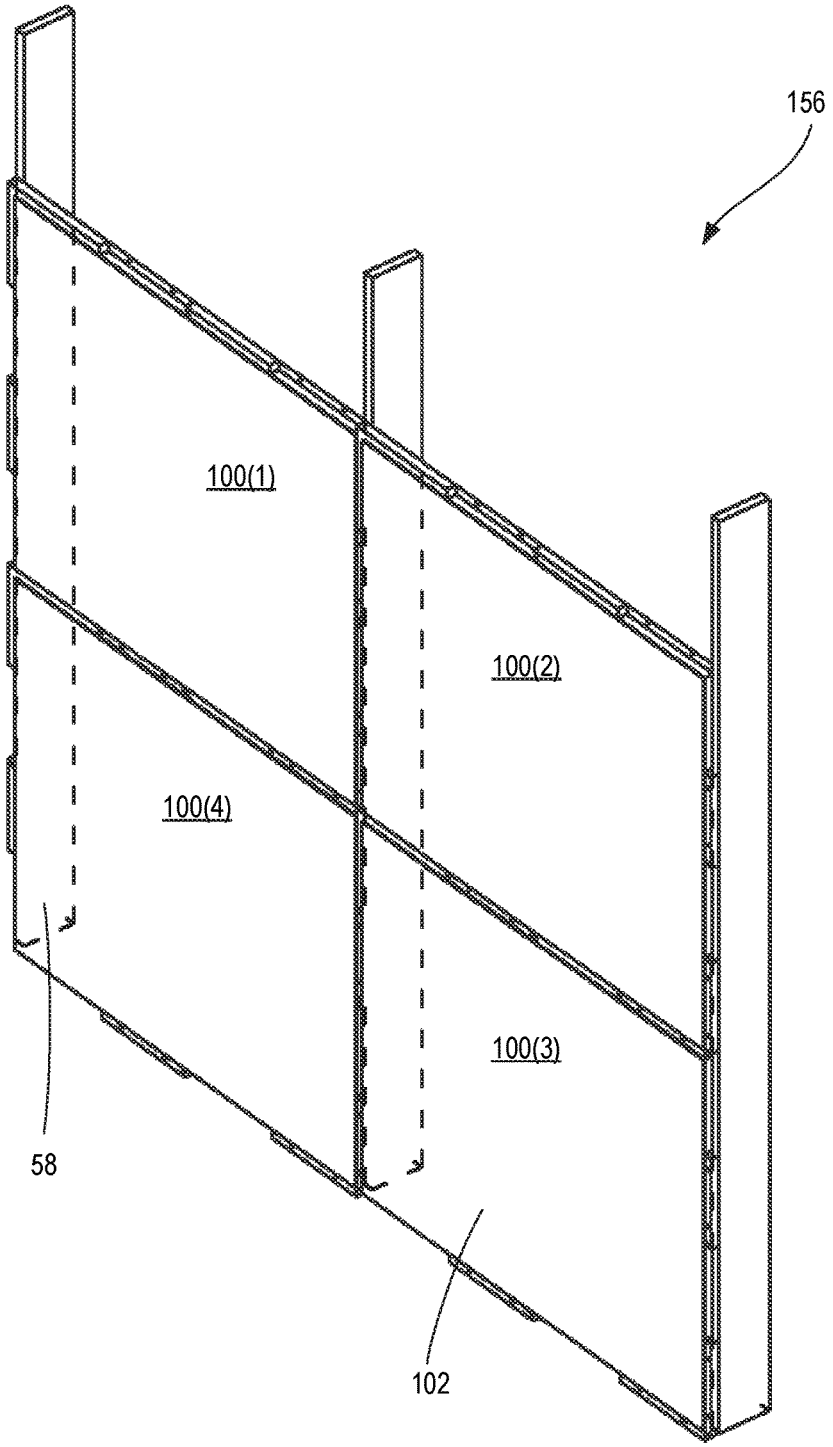
FIG. 27 is a cross-sectional view illustrating attachment of a plurality of pallet caps to structural members of a wall, according to an embodiment.

FIG. 27 shows system 156 affixed to inner surfaces of frame members 58 in order to form an expandable ceiling. Outer surfaces 102 of pallet caps 100 face in, in order to provide a smooth ceiling surface free of ledges that might collect dust.

Figure 28:
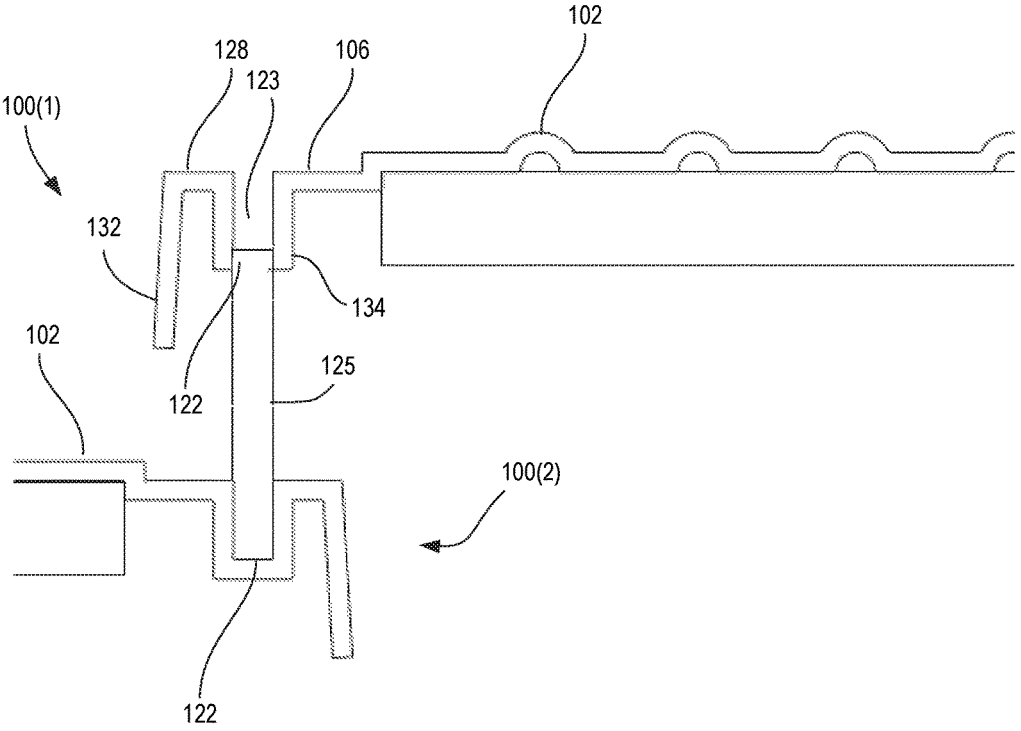
FIG. 28 is a cross-sectional view illustrating alternate connection of two pallet caps to form inner and outer building surfaces.
Figure 29:
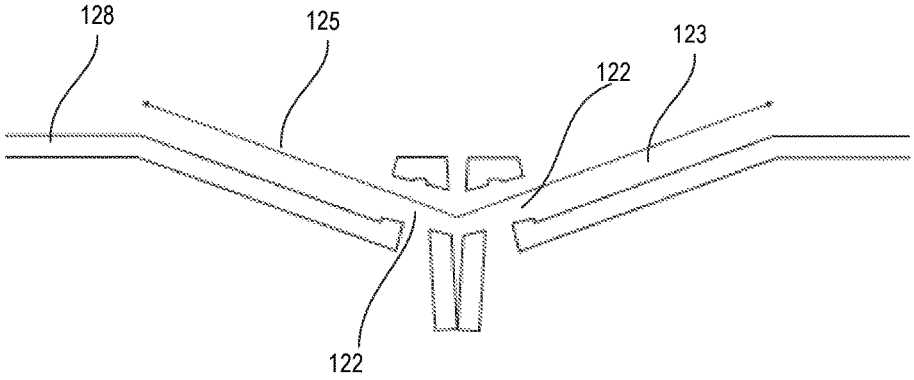
FIG. 29 is another cross-sectional view illustrating alternate connection of two pallet caps.

FIGS. 28 and 29 illustrate alternate connection of pallet caps 100. In FIG. 28, caps 100(1) is shown in cross-section through an edge extension 106, positioned slightly behind cap 100(2), also shown in cross-section through an edge extension 106. It will be appreciated that caps 100(1) and 100(2) are positioned such that edge extensions 106 join with complimentary edge notches 108; however, for clarity of illustration, complete caps 100(1) and 100(2) are not shown. Pallet caps 100(1) and 100)2) are shown extension 106-to-extension 106 in FIG. 29; however, it should again be noted that the cross-section of pallet cap 100(1) is positioned behind the cross-section of pallet cap 100(2).

Edge extensions 106 may include a slot 123, in which apertures 122 are located. A fastener 125 may be inserted into slots 123 and through apertures 122, to laterally join pallet caps 100(1) and 100(2) without extending above top surfaces 102.

Figure 30:
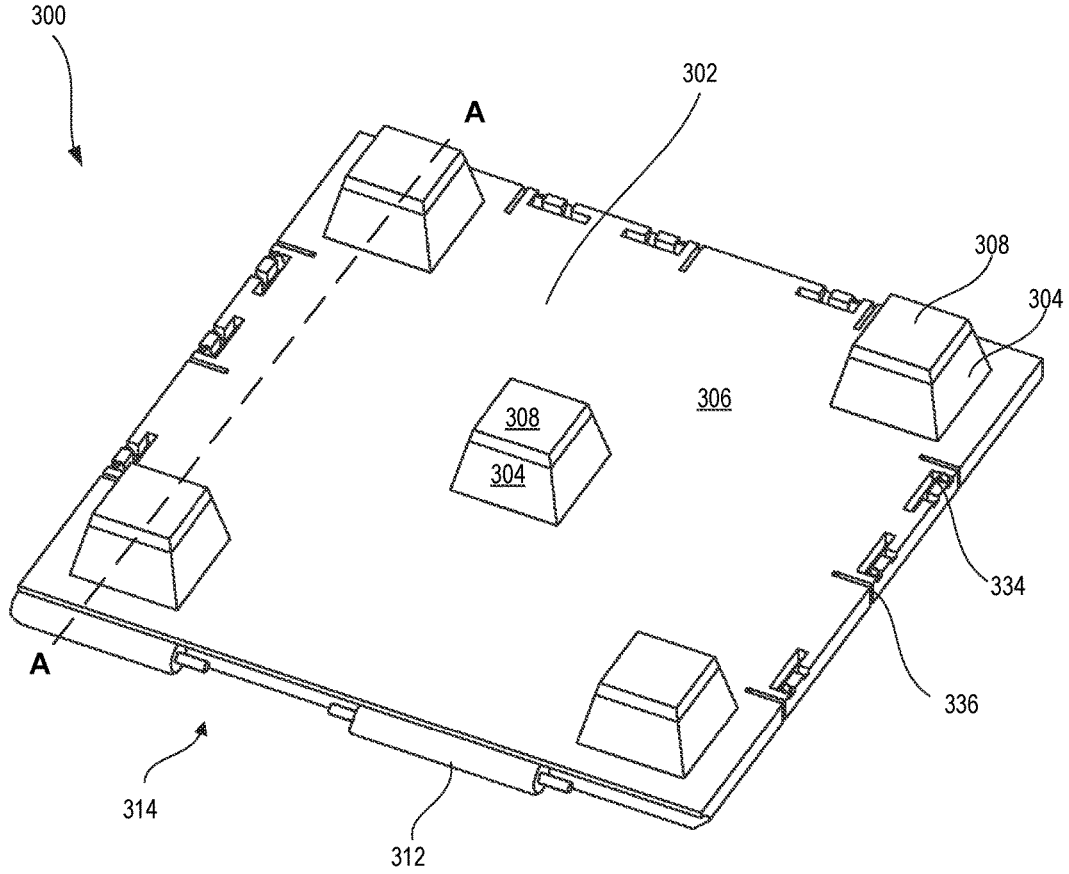
FIG. 30 is bottom, perspective view of a pallet, according to an embodiment.
Figure 31:
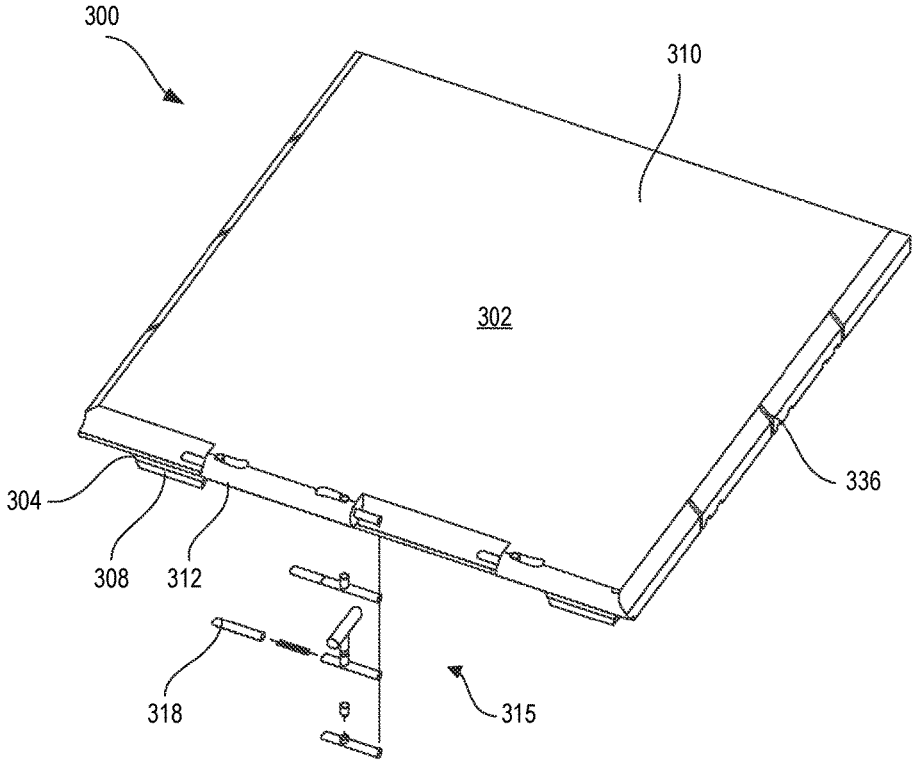
FIG. 31 is a top, perspective view of the pallet of FIG. 30.

FIGS. 30 and 31 show a flat transport structure or pallet 300 including a reinforced platform 302 resting upon 5 individual feet or footings 304 extending from a bottom surface 306 (FIG. 30). Footings 304 are shown tapering to a flat base 308 for contacting ground or other resting surface. Optionally, base 308 may be textured or formed with surface features such as divots, grooves and the like, to increase frictional contact between footings 304/bases 308 and a ground surface. Likewise, footings 304 may be non-tapering and/or take on a cylindrical or other shape.

Pallet 300 has a top surface 310. FIG. 31 illustrates top surface 310 as a continuous, flat surface; however, it will be appreciated that top surface 310 may be textured or include bumps, grooves, or other surface features (e.g., to increase a coefficient of friction of top surface 310) as described and illustrated with respect to pallet cap 100, without departing from the scope hereof. Top surface 310 may likewise be treated with a non-slip or non-skid coating.

The effective clear space beneath pallet 300, as provided by height of footings 304, is designed to accommodate powered industrial trucks, forklifts and other transport equipment. The size of platform 302 may vary along with the number and placement of footings 304 according to intended use. Pallet 300 and/or its components may be made of plastic, wood, metal, composite materials and combinations thereof.

Figure 32A:
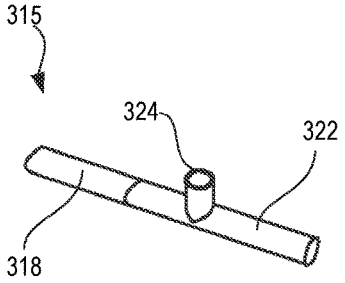
FIGS. 32A-32C illustrate a compression assisted slide-bolt as also shown in FIG. 31
Figure 32C:
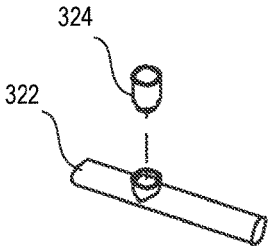
Figure 32B:
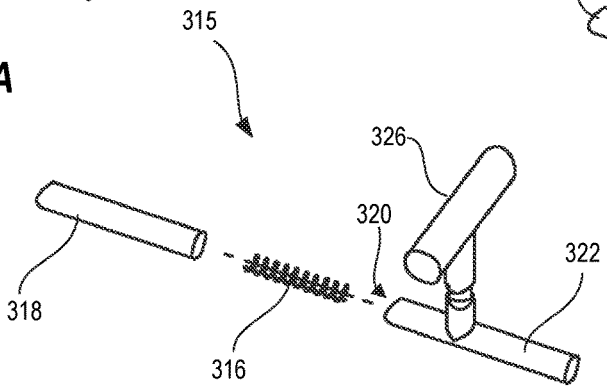

As illustrated in FIG. 31, a barrel housing 312 extends from or is configured with an edge 314 of pallet 300. Barrel housing 312 houses a compression-assisted slide bolt assembly 315, for joining pallet 300 with an edge of another pallet 300. As further shown in FIGS. 32A-32C, compression assisted slide bolt assembly 315 includes a spring 316 and spring-biased bar 318 housed within a channel 320 of a cylindrical housing 322. A locking member 324 may be unlocked (e.g., pressed) by a key 326 to release spring 316, allowing the spring to expand and push bar 318 further out of housing 322. As such, two pallets 300 may be aligned edge-to-edge, with barrel housing(s) 312 of one pallet 300 aligning with edges 314, between or proximate barrel housing(s) 312 of the other pallet. Once barrel housings 312 of independent pallets 300 are aligned, key 326 may be actuated to release spring-biased bars 318 and join pallets 300 through channels 320.

Figure 33:
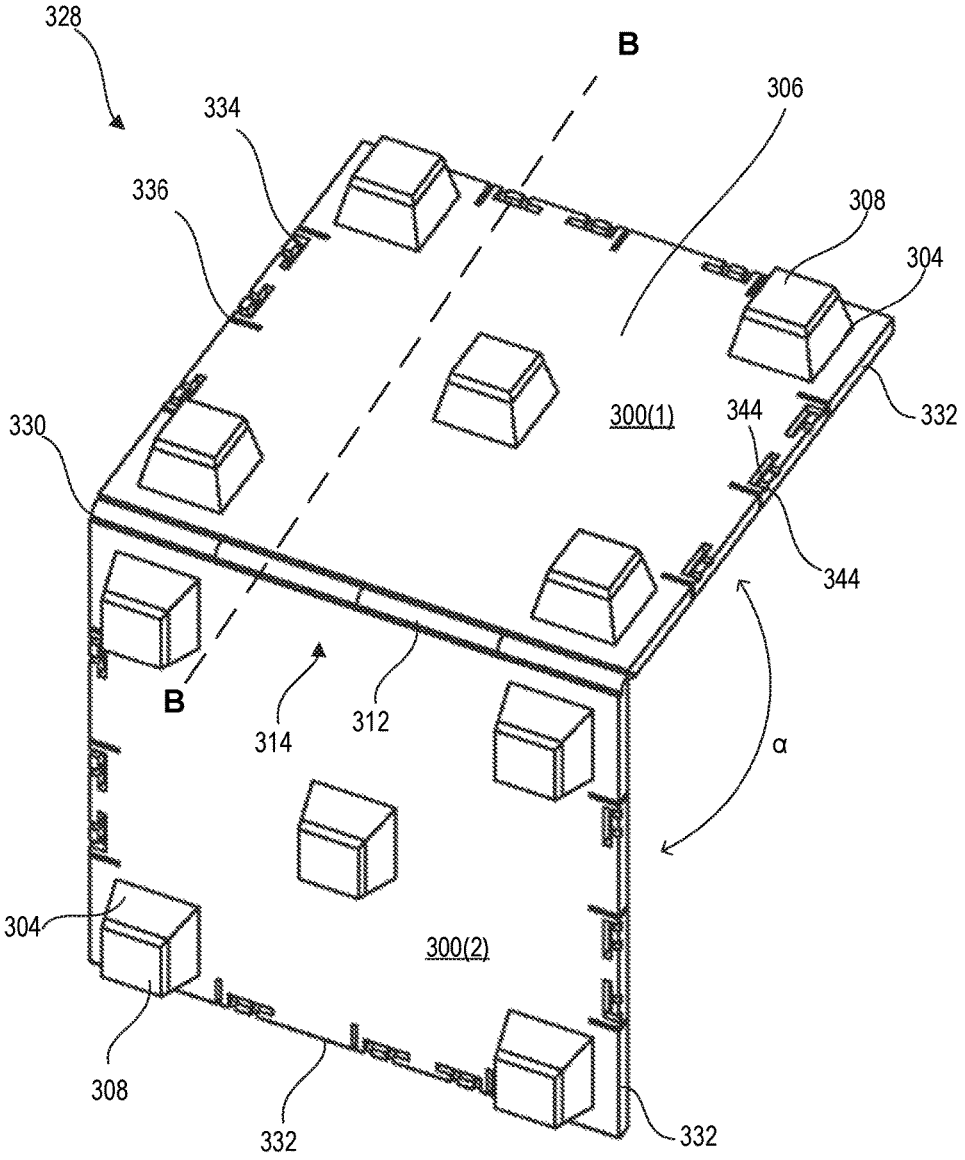
FIG. 33 shows two pallets of FIG. 30 assembled together, according to an embodiment.
Figure 34:
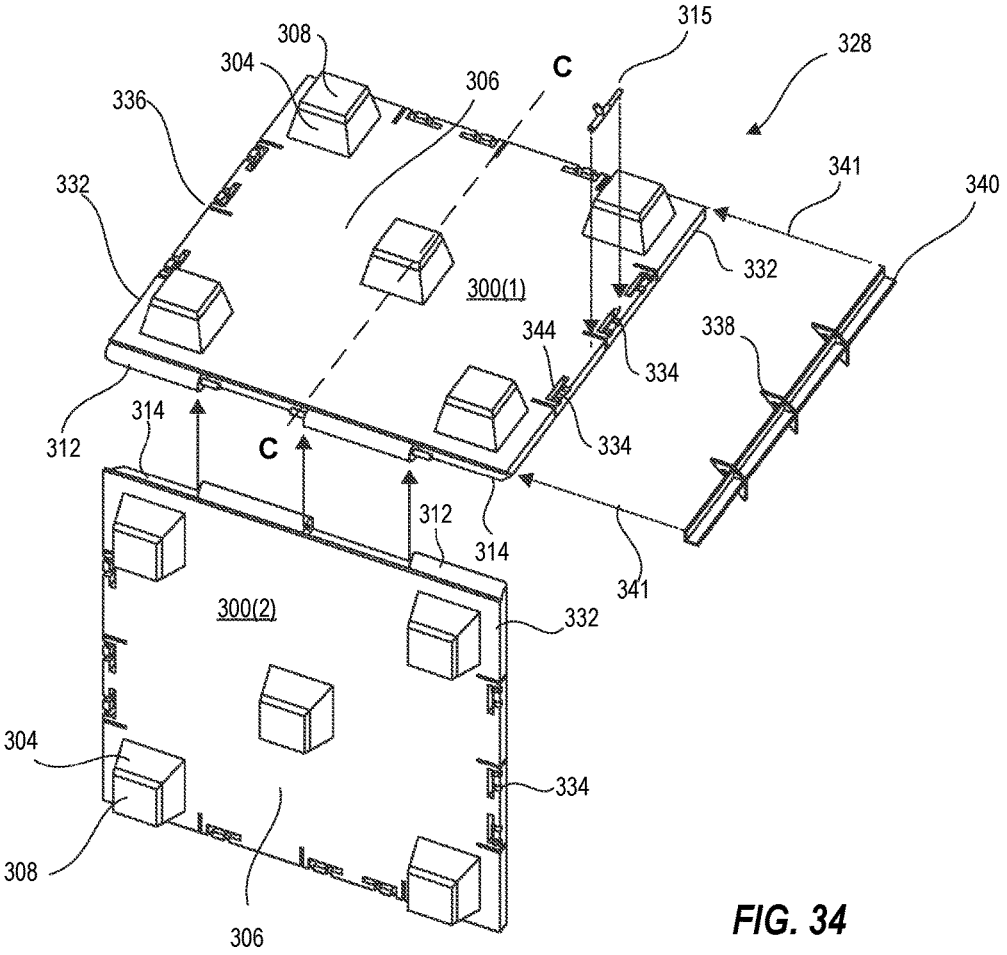
FIG. 34 is an exploded view of the two-pallet assembly of FIG. 1, illustrating placement of slide-bolts (see also FIG. 35) and a lock bar, for holding the assembly together.
Figure 37:
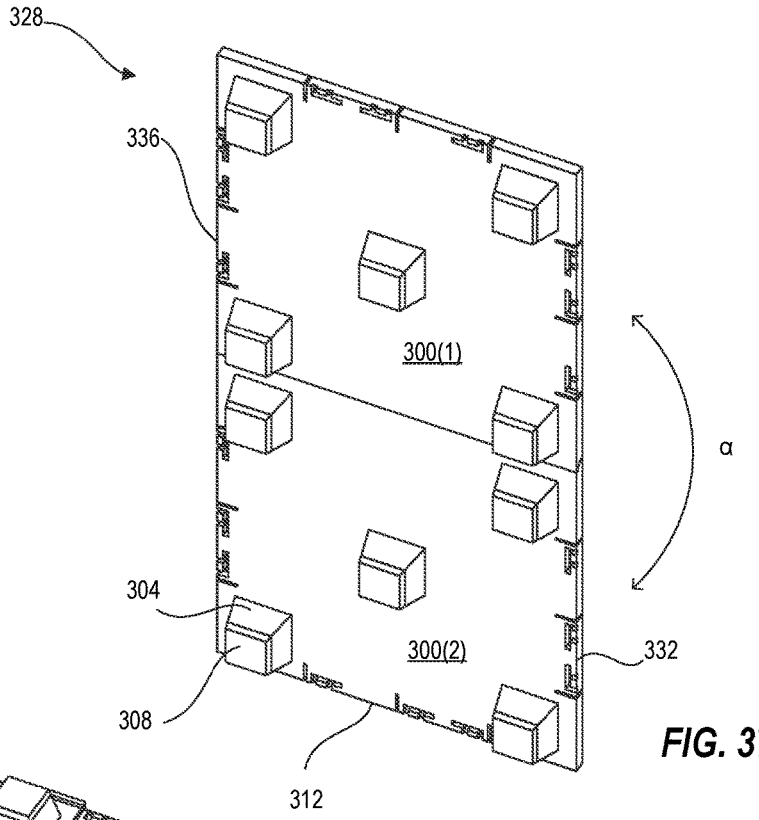
FIG. 37 is a bottom view of a two-pallet assembly, according to an embodiment.

FIGS. 33, 34 and 37 illustrate a two-pallet assembly 328. Two pallets 300(1) and 300(2) are shown joined perpendicular to one another. It will be appreciated that slide-bolt assembly 315 and barrel housings 312 create a hinge 330 between pallets 300(1) and 300(2), such that an angle $\alpha$ between pallets 300(1) and 300(2) may be varied. For example, as shown (in less detail) in FIG. 37, pallets 300(1) and 300(2) are joined in-plane to form a 180° angle $\alpha$. Such pallet orientation may be desirable when a pallet assembly 328 or an extended pallet assembly is to serve as a raised floor, structural wall, ceiling or roofing component.

Figure 35:
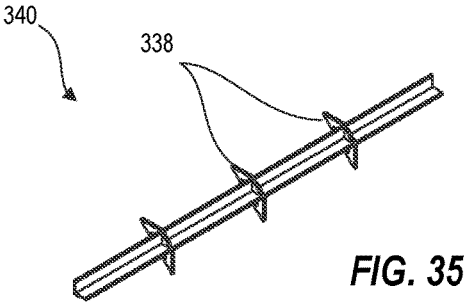
FIG. 35 is a top, perspective view of the lock bar of FIG. 34
Figure 36:
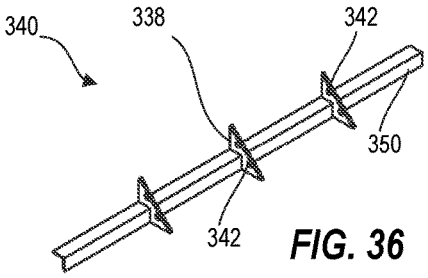
FIG. 36 is a bottom, perspective view of the lock bar of FIGS. 34 and 35.

Edges 332, adjacent and opposite edges 314 of pallets 300, form one or more slide-bolt housings 334 and lock bar slots 336. Lock bar slots 336 accept fins 338 of a lock bar 340 when inserted as shown by arrows 341. Lock bar 340 is shown from the top in FIG. 35 and from the bottom, in FIG. 36. Fins 338 of lock bar 340 form apertures 342. When fins 338 are inserted into slots 336, apertures 342 align with channels 344 of slide bolt housings 334, such that when actuated by key 326, compression assisted slide-bolts 318 secure lock bar 340 in place. Additional pallets, such as pallet 300(3), may join with pallets 300(1) and 300(2) via lock bars 340 to form a crate assembly 346, as shown in FIG. 38 and exploded FIG. 39.

Figure 38:
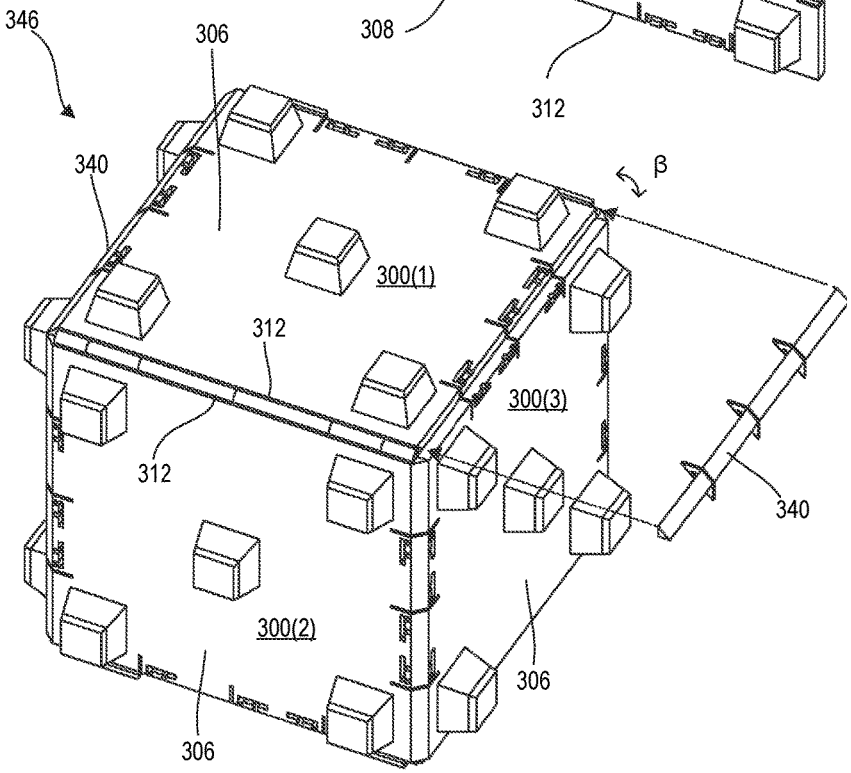
FIG. 38 shows a crate assembly formed with pallets of FIG. 30, according to an embodiment.
Figure 39:
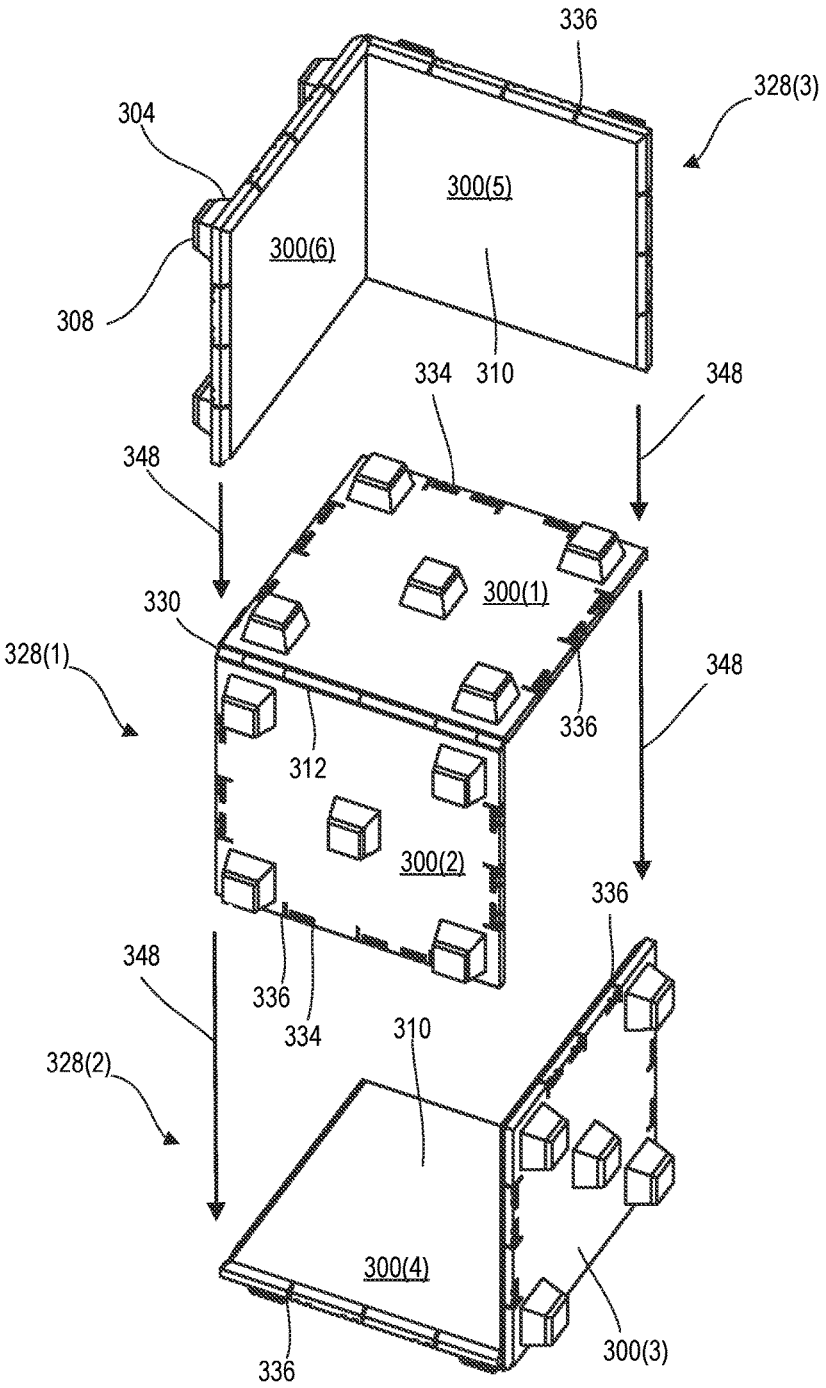
FIG. 39 is an exploded view showing exemplary pallet placement in the crate assembly of FIG. 38.

In one aspect, shown in FIGS. 38 and 39, crate assembly 346 is formed with bottom surfaces 306 facing outward, such that crate assembly 346 may rest upon footings 304 regardless of which pallet 300 faces ground. Alternately, footings 304 may be sized and tapered such that crate assembly 346 may be formed with one or more top surfaces 310 facing outward, to form one or more flat sides. This may be desirable when crate assembly 346 is used as a step or seat, solely or in addition to use as a storage crate, or when multiple crate assemblies 346 are to be tightly packed together. It will be appreciated that regardless of orientation, key 326 may be used to lock slide-bolt assemblies 315 in place, to protect contents of crate assembly 346 from theft.

As shown in FIG. 39, three two-pallet assemblies 328(1)-328(3) (FIGS. 33 and 34) combine, for example as indicated by arrows 348, to form crate assembly 346 (hereinafter, also referred to as crate 346). Crate 346 is held together by a series of additional compression assisted slide-bolts 318 placed with slide bolt housings 334, in conjunction with multiple lock bars 340 that join two-pallet assemblies 328 in a perpendicular arrangement. A bottom surface 350 of lock bars 340 forms a wedge to fit an angle β between edges 332 of adjacent pallets 300. Whereas hinge 330 permits relative movement of pallets 300, the wedge shape and fins of lock bars 340 "lock" pallets 300 in place perpendicular to one another. Lock bars 340 facilitate transferal of vertical and horizontal loads to pallets 300 when joined to form crate 346. This load transferal is accomplished by feeding lock bars 340 into slots 336, which as noted above are punctured by compression assisted slide-bolts 318. The FIG. 38, 39 arrangement of three two-pallet assemblies 328 combining to form crate 346 is one possible volumetric configuration of multiple two-pallet assemblies 328. Other configurations of additional two-pallet assemblies, for example to form stairs, joined seating and other structures, are within the scope hereof.

Figure 40:
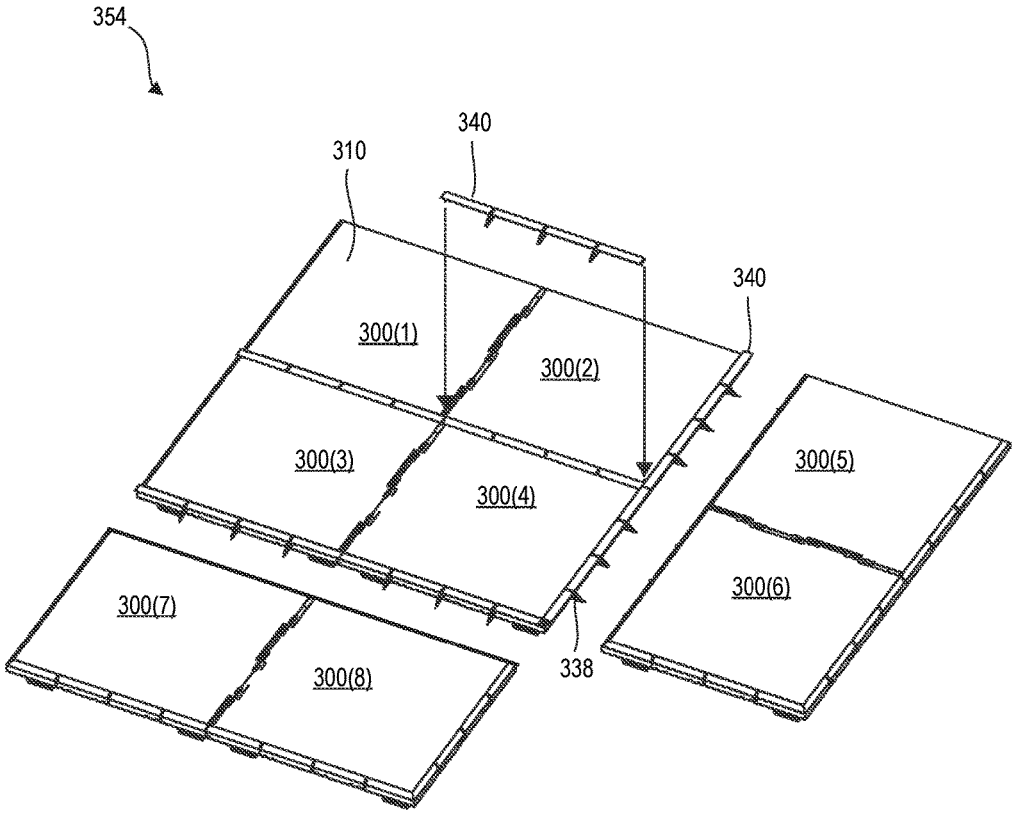
FIG. 40 shows an expandable flooring system formed of the pallets of FIG. 30, according to an embodiment.

FIG. 40 illustrates an expandable flooring system 354 composed of pallets 300(1)-300(8) and associated fasteners. It will be appreciated that additional pallets 300 and associated fasteners may be added, without departing from the scope hereof. Size and shape of edges 332 of pallets 300 permit fit of lock bars 340 therebetween, when pallets 300 are oriented in-plane. Compression assisted slide-bolts 318 lock pallets 300 together at barrel extensions via slots 336 (and further via slide bolts 318 placed within slide bolt housings 334 and through apertures 342 of fins 338). Compression assisted slide-bolts 318 and lock bars 340 facilitate the configuration of multiple two-pallet assemblies 328 and/or multiple single pallets 300 as expandable flooring system 354 of a variety of shapes and sizes. Flooring system 354 may thus be customized to best fit the shape and size of a building, such as a refugee housing unit in the field, to form a raised floor.

Figure 41:
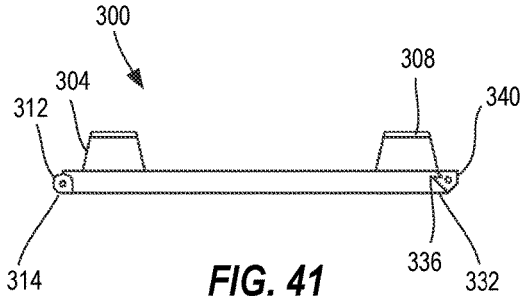
FIG. 41 is a cross-sectional view of the pallet of FIG. 30 through a lock bar slot, according to an embodiment.
Figure 42:
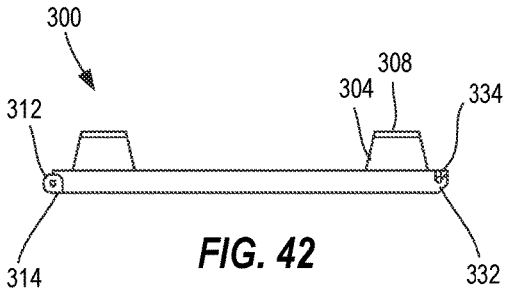
FIG. 42 is a cross-sectional view of the pallet of FIG. 30 through a slide-bolt housing, according to an embodiment.
Figure 47:
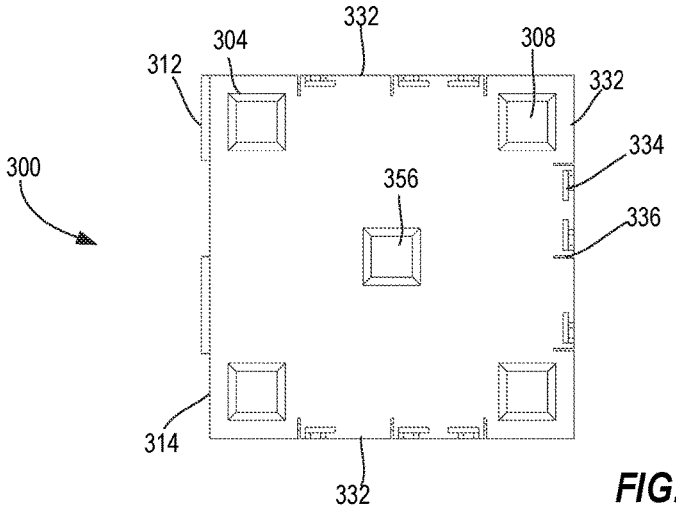
FIG. 47 is a reflected plan view showing the bottom of the pallet of FIG. 30.

FIGS. 41-44 are cross-sectional views through various locations on pallet 300, as also shown in FIG. 47. FIG. 41 is a cross-sectional view through line A-A, FIG. 30, illustrating barrel housing 312 and lock bar slot 336, at opposing edges 314 and 332. FIG. 42 shows pallet 300 through line B-B of FIG. 33, which intersects slide bolt housing 334.

Figure 43:
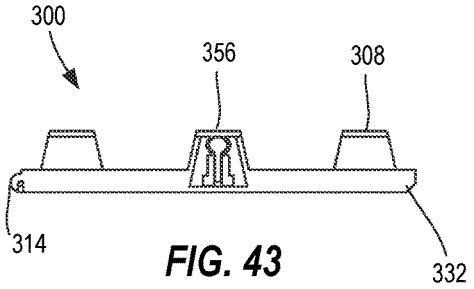
FIG. 43 is a cross-sectional view of the pallet of FIG. 30 through an adjustable footing, according to an embodiment.
Figure 44:
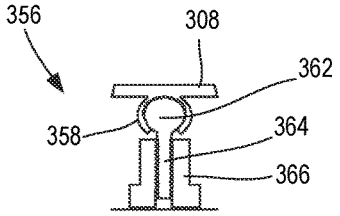
FIG. 44 is an enlarged view of components of the adjustable footing, positioned as shown in FIG. 43.
Figure 45:
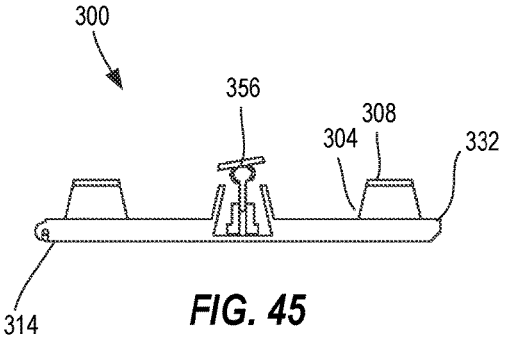
FIG. 45 illustrates motion of the adjustable footing of FIG. 43.
Figure 46:
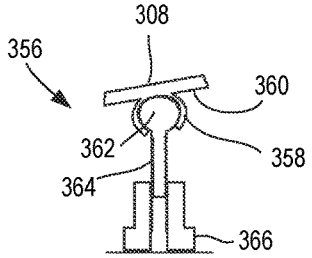
FIG. 46 is an enlarged view of components of the adjustable footing, positioned as shown in FIG. 45.

FIG. 43 is a cross-sectional view of pallet cap 100 through line C-C of FIG. 34, which in this case cuts through an adjustable central footing 356. Adjustable footing 356 is also illustrated in FIGS. 44-46, which should be viewed together with FIG. 46 and the following description. It will be appreciated that any of footings 304 of pallet 300 may be an adjustable footing such as footing 356. Adjustable footing 356 features a collar 358 extending from a bottom surface 360 of base 308. Collar 358 fits with and swivels/rotates upon a ball end 362 of a threaded ball pin 364. A pin end of ball pin 364 fits within a threaded base 366, holding threaded ball pin 364 stationary. It will be appreciated that height of adjustable footing 356 may be adjusted by screwing ball pin 364 in or out of threaded base 366. Vertical position and angle of adjustable footing 356 may therefore be customized to best fit a surface. This customization may be especially helpful on uneven ground, allowing for creation of a level raised flooring system with reduced site preparation.

Figure 48:
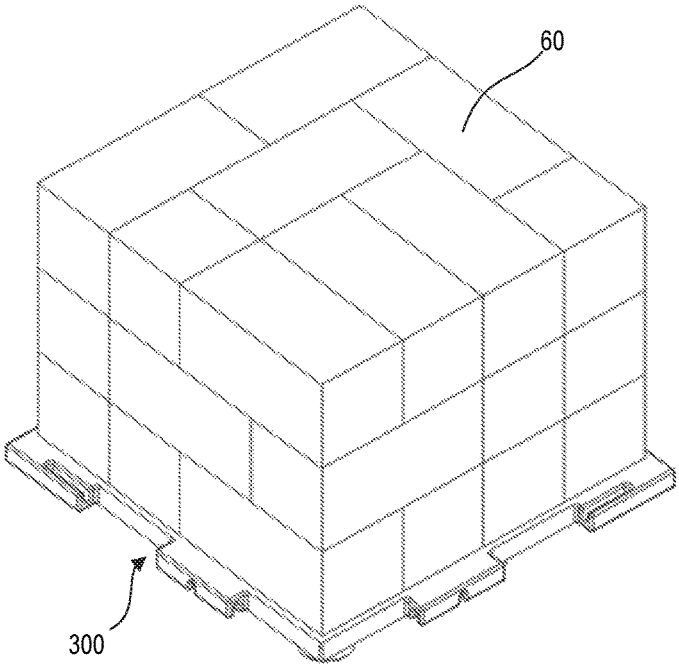
FIG. 48 is a top, perspective view of a pallet supporting goods, according to an embodiment.
Figure 49:
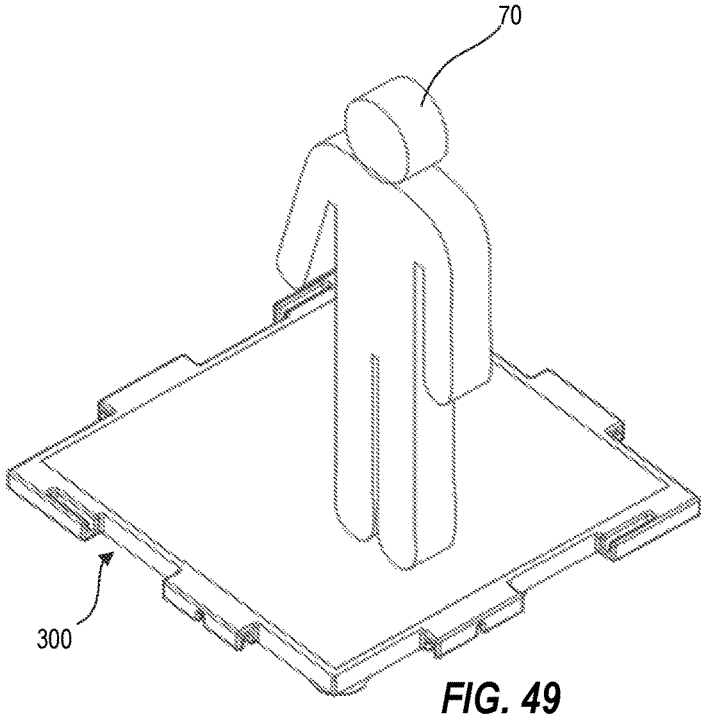
FIG. 49 is a top, perspective view of the pallet of FIG. 48, unloaded and supporting a person.
Figure 50:
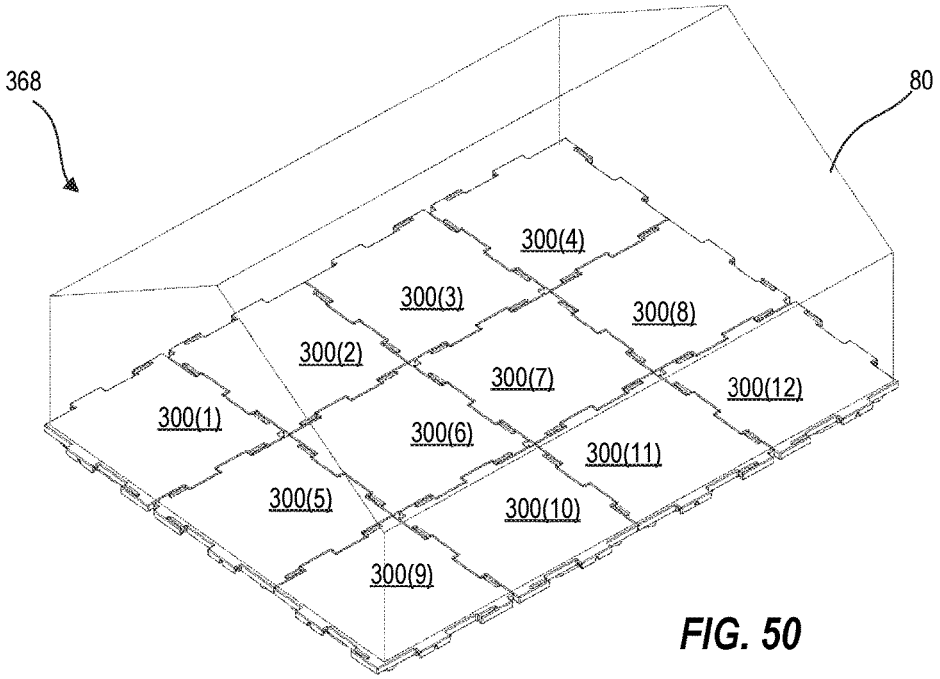
FIG. 50 is a top, perspective view of a plurality of pallets, such as the pallets of FIGS. 48 and 49, assembled together to form a raised floor, according to an embodiment.

FIG. 48 illustrates a pallet 300 supporting cargo 60. Cargo 60 may be boxed or un-boxed. FIG. 49 schematically shows a person 70 standing atop pallet 300, and illustrates relative size of pallet 300 relative to person 70, although this may vary. FIG. 50 illustrates an expandable flooring system 368 within a shelter 80. Expandable flooring system 368 is shown with 12 interconnected pallets 300 joined with top surfaces 310 facing up to form a smooth floor. It will be appreciated that more pallets, less pallets, or alternate configurations of pallets may form expandable flooring system 368.

FIGS. 51-55 show interconnection of alternately configured pallets 400. Features of pallets 300 and pallets 400 may be swapped, interchanged and/or combined without departing from the scope and spirit of the inventions disclosed herein. Therefore, similar features of pallets 300 and 400 are given like numbering within different series (300 and 400).

Pallets 400 include a reinforced platform 402, with a plurality of individual feet or footings, generally designated as footings 404, extending from a bottom surface 406 thereof. Footings 404 include tapering, cylindrical feet 405, tapering, rounded rectangular feet 407 and a central, tapering, rounded square foot 309, specifically labeled in FIGS. 52, 54 and 55. All footings 404 are shown with circular depressions or apertures 411 within a base 308. Depressions 411 increase surface area contact and friction between footings 404 and a ground surface, and may therefore aid in securing pallets 400 with ground. Depressions 411 may likewise be formed within bottom surface 406. In addition to increasing contact area with a ground surface and frictional contact with ground, depressions 411 may allow for in-packing of a supporting or insulating material disposed between pallet 400 and the ground, or provide insulating air spaces. Depressions 411 also reduce material required to manufacture pallet 400, thereby reducing direct cost, pallet 400 weight and shipping-related costs. Where replacing or combining with depressions 411, apertures 411 prevent moisture accumulation atop pallets 400.

Figure 51:
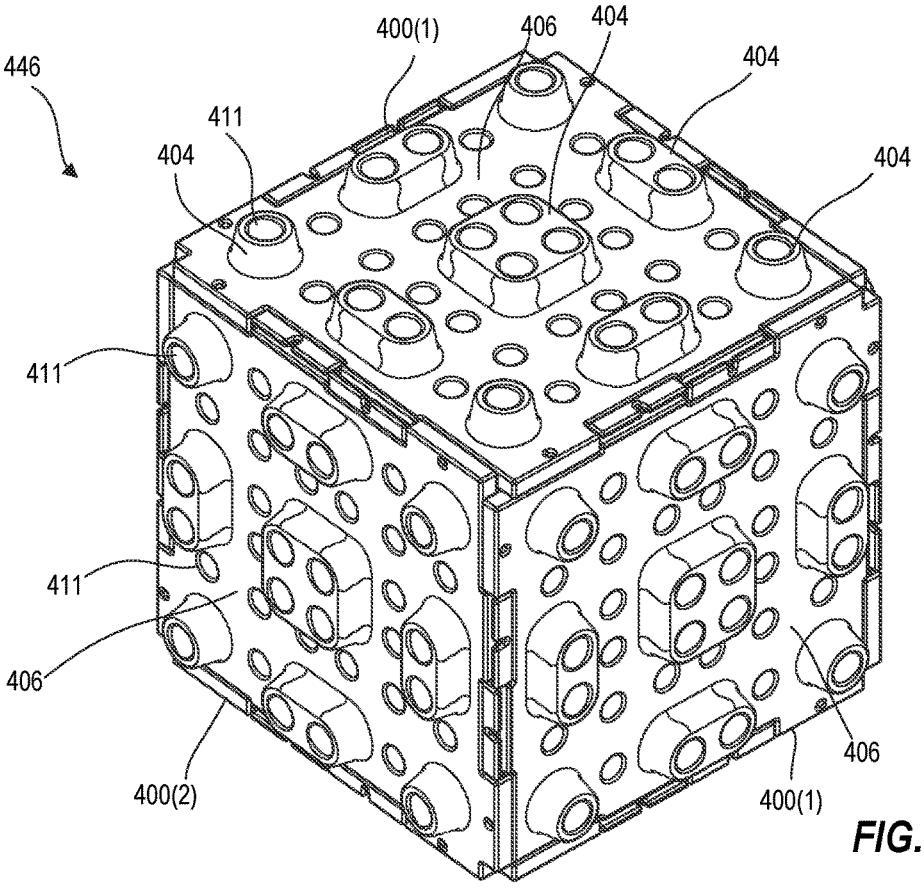
FIG. 51 is a top, perspective view of a plurality of pallets, such as the pallets of FIGS. 48 and 49, assembled together to form a crate, according to an embodiment.

As shown in FIG. 51, pallets 400 may be configured as a crate 446 with bottom surfaces 406 facing outward. However, crate 446 may also be formed with one or more pallets 400 facing inward, such that a smooth top surface 410 forms at least one face of crate 446. Smooth outer faces may be desirable where crate 446 is to serve as a seat, step or table in addition to a lockable storage container.

Figure 52:
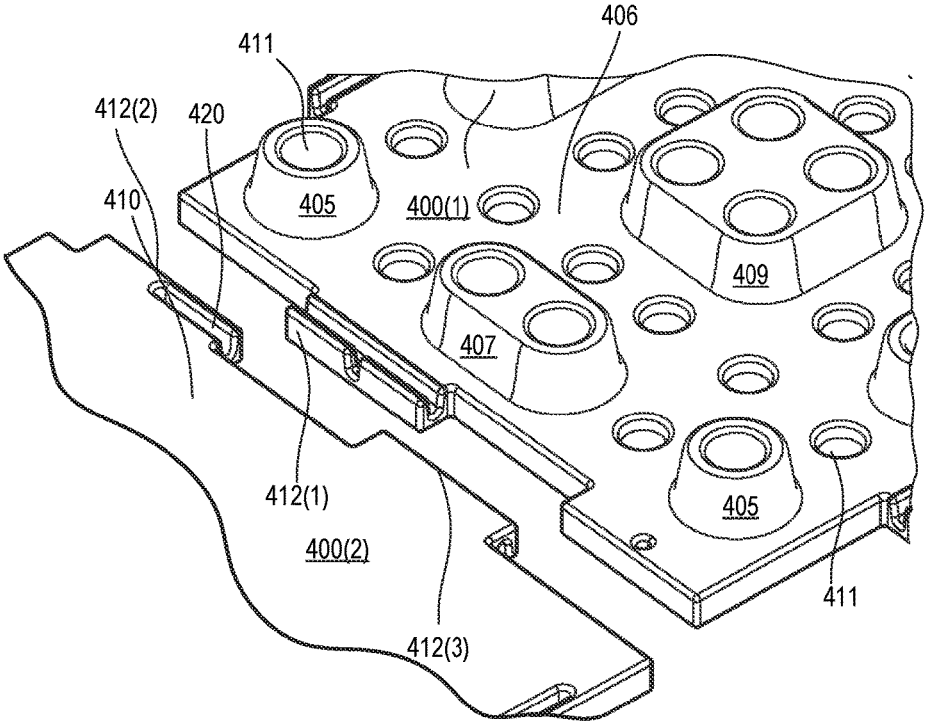
FIG. 52 schematically illustrates opposing side alignment of two pallets, such as the pallets of FIGS. 48 and 49, showing complementary features for aligning and interlocking the pallets, according to an embodiment.

FIG. 52 illustrates bottom-to-top lateral connection between two pallets, 400(1) and 400(2). Bottom surface 406 of pallet 400(1) joins adjacent top surface 410 of pallet 400(2), via complementary extensions 412 having channels 420 formed therein. As shown, extension 412(1) of pallet 400(1) fits between extensions 412(2) and (3) of pallet 400(2), such that aligned channels 420 form a continuous channel through adjoined edges 414 of pallets 400(1 and 400(2).

Figure 53:
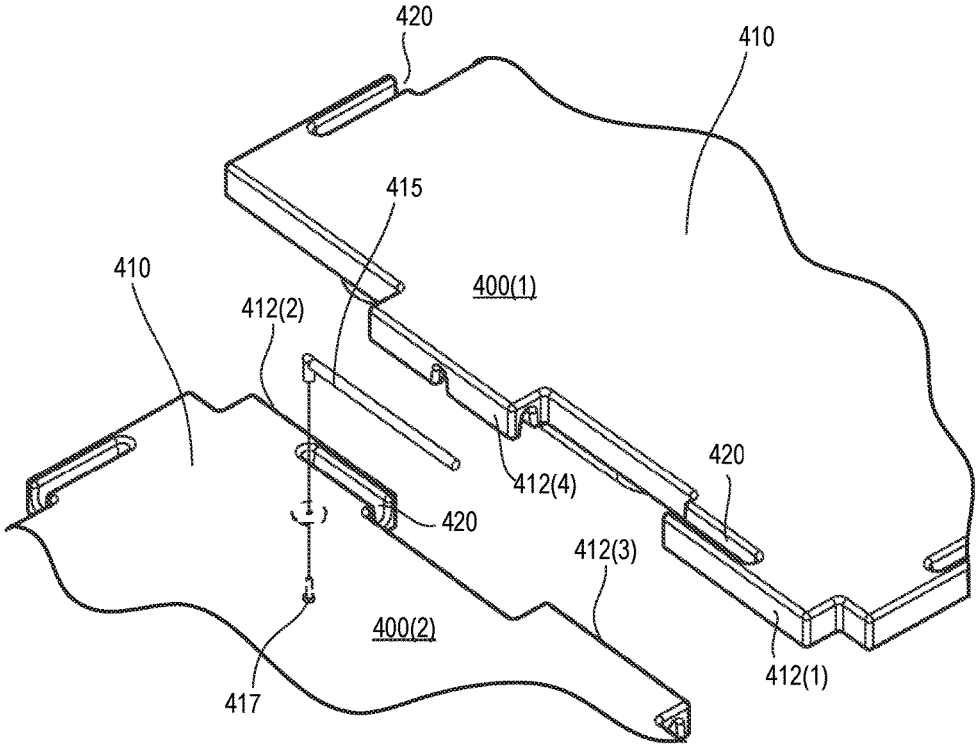
FIG. 53 is an isometric perspective view, schematically illustrating like-side alignment of two pallets, such as the pallets of FIGS. 48 and 49, showing complementary features for aligning and interlocking the pallets, according to an embodiment.

FIG. 53 illustrates top surface 410-to-top surface 410 lateral connection of pallets 400(1) and 400(2). Here, extension 412(4) of pallet 400(1) fits between extensions 412(2) and 412(3) of pallet 400(2), with extension 412(1) fitting with an opposing side of extension 412(3) of pallet 400(2). One or more slide bolts secures pallets 400(1) and 400(2) together. For example, slide bolt 415 fits within adjacent channels 420 of extensions 412(2) and 412(4), and pierces channel 420 of extension 412(2) to connect with a washer and security screw assembly 417 on an opposite side (bottom side 406) of pallet 400(2).

Figure 54:
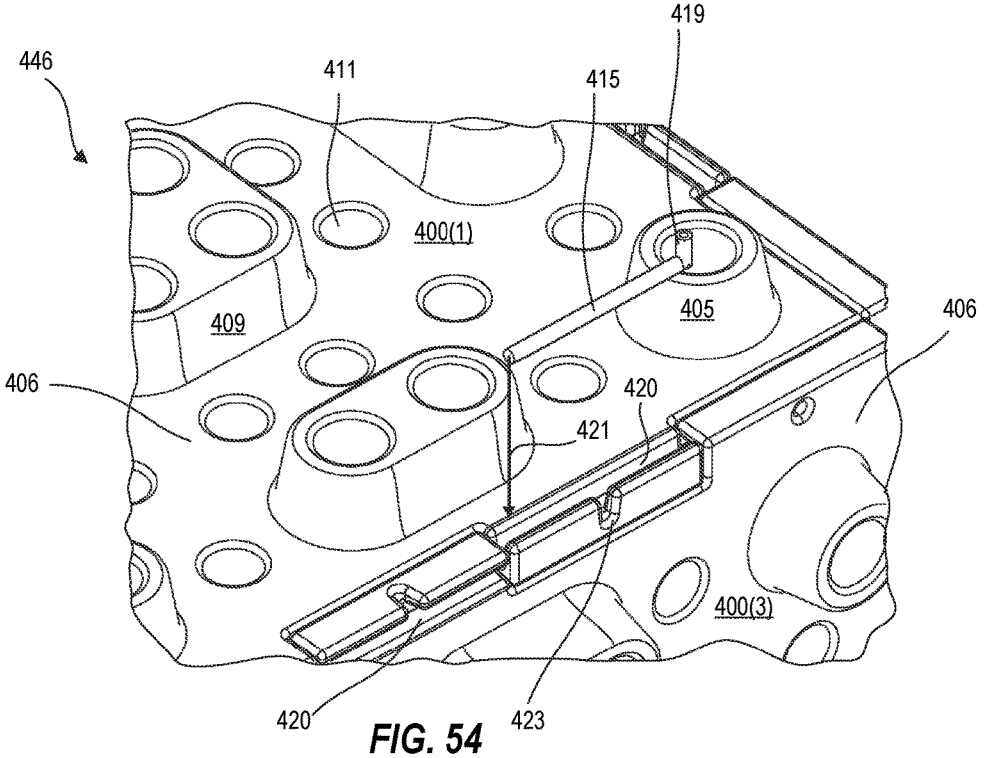
FIG. 54 shows two pallets aligned edge to edge and perpendicular to one another, further illustrating placement of a slide bolt within a channel formed by the aligned edges, according to an embodiment.
Figure 55:
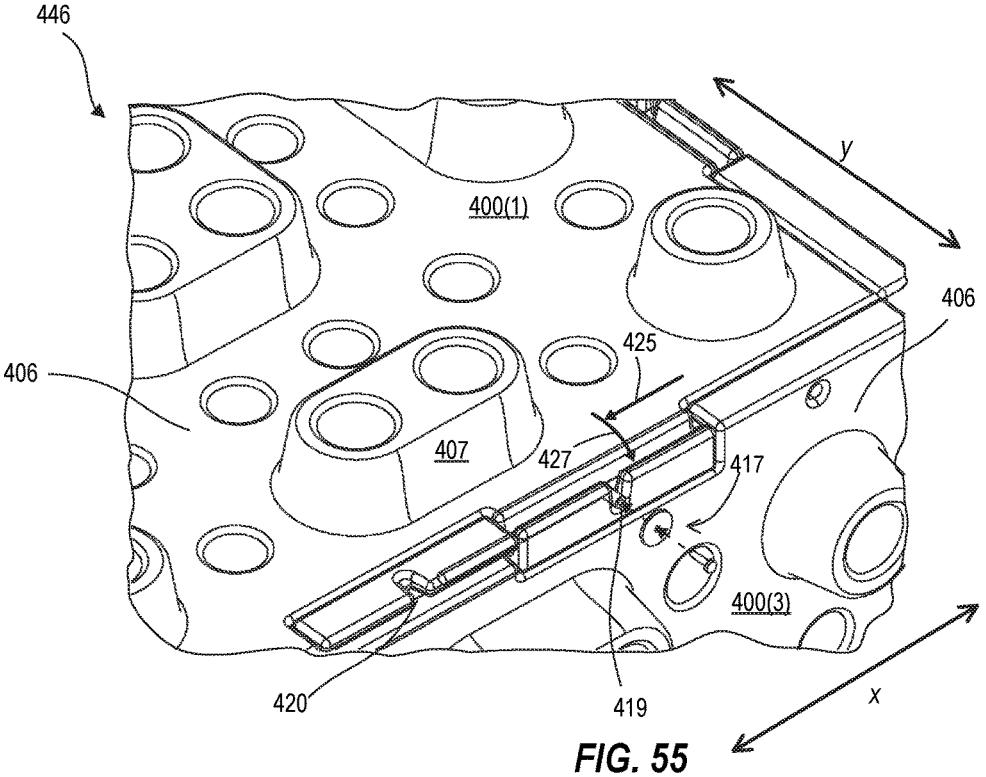
FIG. 55 illustrates advancement and rotation of the slide bolt within the channel of FIG. 54, to lock the pallets together, according to an embodiment.

FIGS. 54 and 55 illustrate connection of pallets 400(1) and 400(3) in crate 446 of FIG. 51. Once pallets 400(1) and 400(3) are fitted together, slide bolt 415 is inserted into channel 420 of pallet 400(1), as indicated by directional arrow 421 (FIG. 54). Slide bolt 415 is then advanced forward and rotated such that a head 419 of slide bolt 415 fits with a notch 423 formed within extension 412 and normal to channel 420 (see arrows 425 and 427, FIG. 55). Washer and security screw assembly 417 is connected with bolt head 419 to secure slide bolt 415 within aligned channels, from outside of crate 446. It will be appreciated that multiple slide bolts 415 may be used to secure crate 446 together via multiple channels 420. Each slide bolt 415 connection may secure two pallets 400 together in two axes. When in crate 446 form, the slide bolt 415 connections work together to constrain the third axis of every other joint of crate 446. For example, as shown in FIG. 55, slide bolt 415 and washer and security screw assembly 417 prevent movement of pallet 400(1) along the x axis and prevent movement of pallet 400(3) along they axis. Slide bolts 415 and washer and security screw assemblies 417 connecting other pallets 400 of crate 446 prevent movement along a z axis (not shown), such that crate 446 is fully secured in place.

Figure 56:
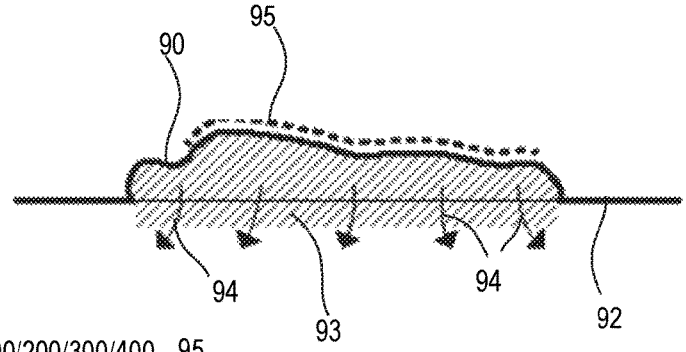
FIG. 56 is a schematic side view illustrating loss of body heat into a ground surface.
Figure 57:
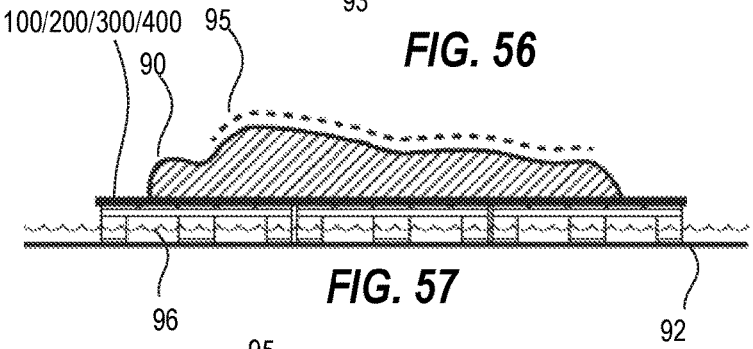
FIG. 57 is a schematic side view illustrating a raised flooring surface, reducing conductive heat loss of a body resting thereupon.
Figure 58:
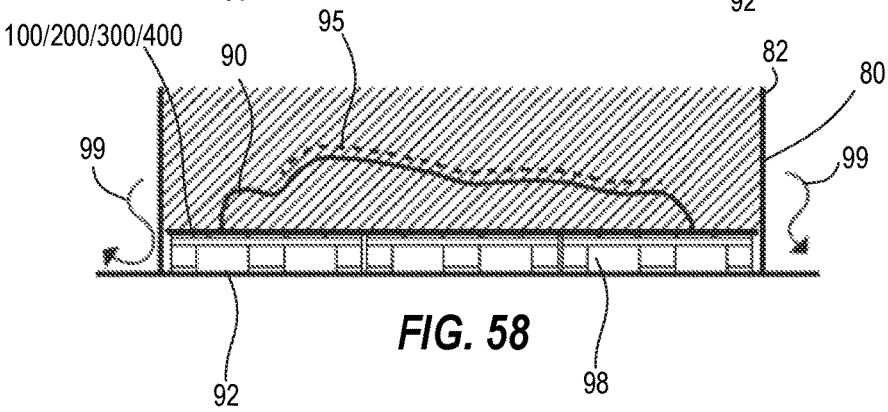
FIG. 58 is a schematic side view illustrating a raised flooring surface within a housing unit, forming an insulative air cavity to preserve body heat of a body resting thereupon.

FIGS. 56-58 schematically illustrate conservation of body heat by raising a person off the ground when sleeping. A person 90 sleeping directly on a ground surface 92 suffers conductive heat loss as body heat (generally indicated by lines 93) flows away from the body into ground 92, as indicated by heat-flow arrows 94. A blanket 95 covering the body cannot prevent heat loss into ground 92. Moisture 96 within ground 92 may further chill person 90, resulting in even greater loss of body heat. When person 90 is raised off the ground atop a flooring system provided by pallets cap 100/200 or pallets 300/400, contact with moisture 96 and loss of body heat is reduced. By placing the flooring system within a structure, such as shelter 80 (FIG. 50), an insulative air cavity 98 is formed beneath pallet caps 100/200 or pallets 300/400 and between walls 82 of shelter 80 (which is for example a refugee housing unit). Exterior airflow indicated by arrows 99 is blocked from the interior of shelter 80, and therefore, airflow beneath pallet caps 100/200 or pallets 300/400 is reduced, thus mitigating convective heat loss in addition to conductive loss of body heat.

Shipping pallet caps 100/200 and pallets 300/400 may be manufactured by injection molding a molten material, such as plastic, into a mold and allowing the material to set. Caps 100/200 and pallets 300/400 may alternately be made by structural foam injection molding, by heat forming, vacuum forming, by rotocasting or rotationally molding, by shaping and compressing a malleable material such as water-resistant paper (e.g., cardboard) or by casting or welding metal forms. However, any method of manufacture that yields a shipping pallet or pallet cap as disclosed herein may be used to form caps 100/200 or pallets 300/400.

In one aspect, a method of manufacturing a pallet cap includes forming a reinforced platform including a top surface, an opposing bottom surface and four edges, each edge including at least one edge extension, at least one edge notch and sidewalls separating and defining adjacent notches and extensions. Each extension includes (a) a horizontal plate extending from and in the plane of the top surface of the platform, and (b) a downwardly-extending outer wall at a distal end of the horizontal plate, the downwardly-extending outer wall forming an obtuse angle with a bottom surface of the horizontal plate and relative to the bottom surface of the platform. Each edge notch includes a rear retaining wall extending downward from the platform at an obtuse angle relative to the platform, and a lower edge plate extending outward from a bottom portion of the rear retaining wall.

Monolithic Interlocking Tile

Figure 59:
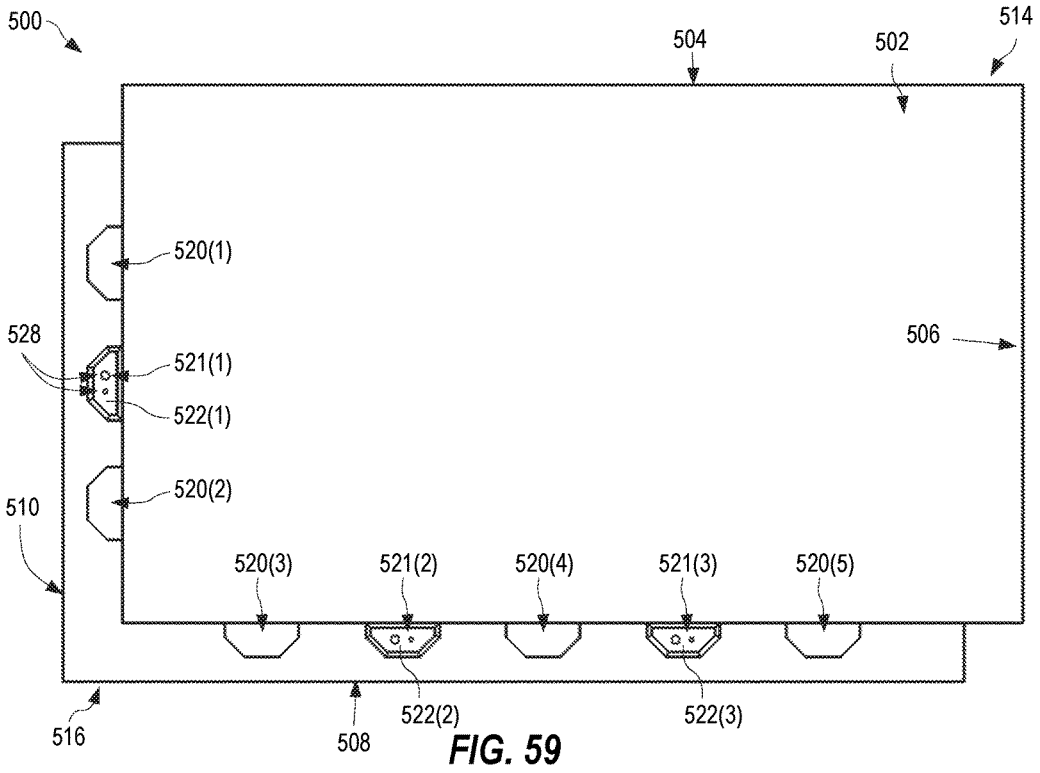
FIG. 59 is a top view of one exemplary interlocking tile, in an embodiment.
Figure 60:
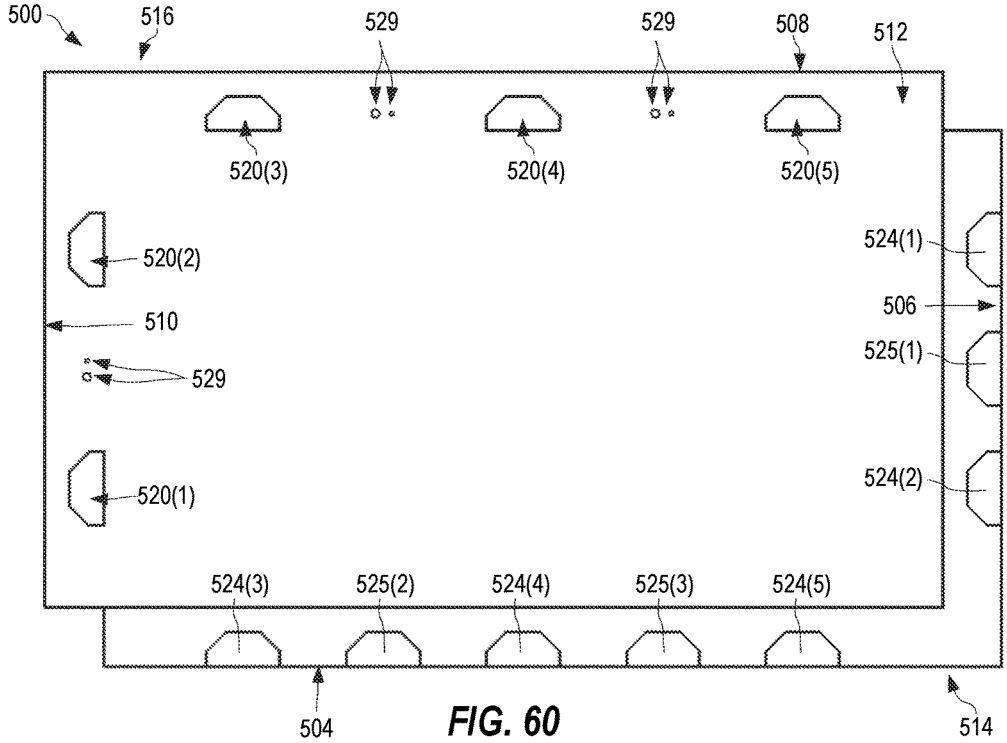
FIG. 60 is a bottom view of the interlocking tile of FIG. 59.
Figure 61:
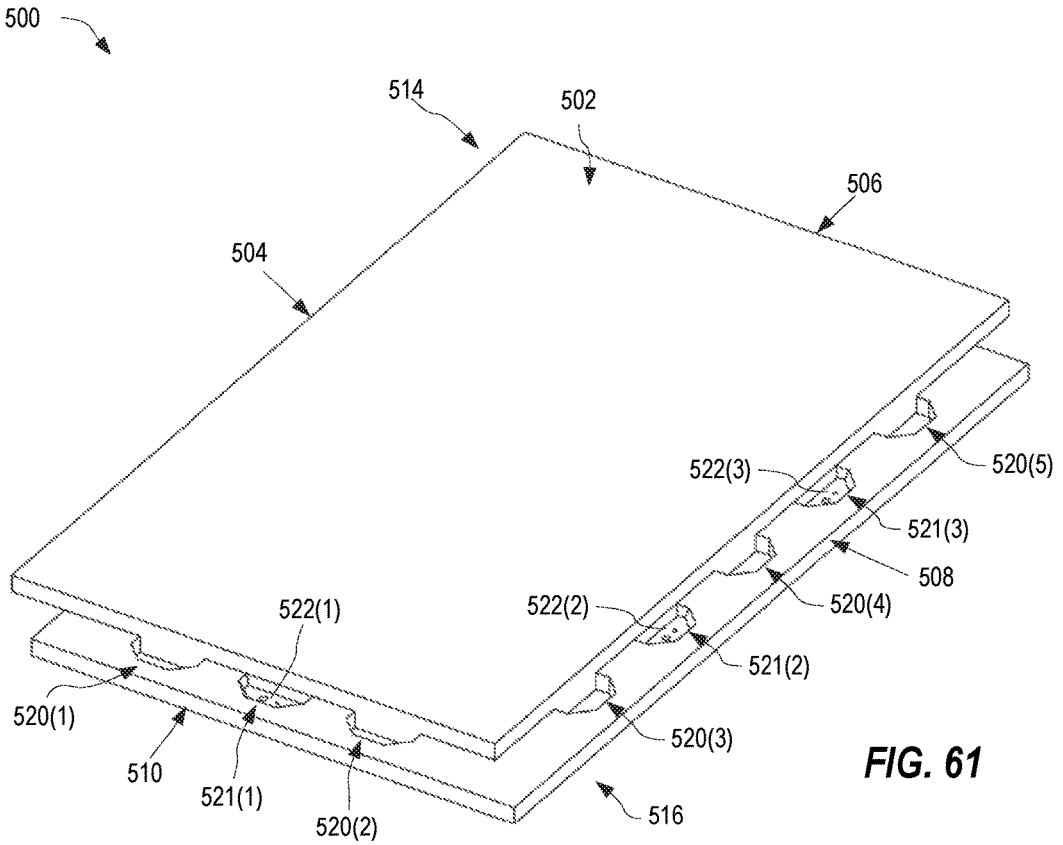
FIG. 61 is a top perspective view of the interlocking tile of FIGS. 59 and 60.
Figure 62:
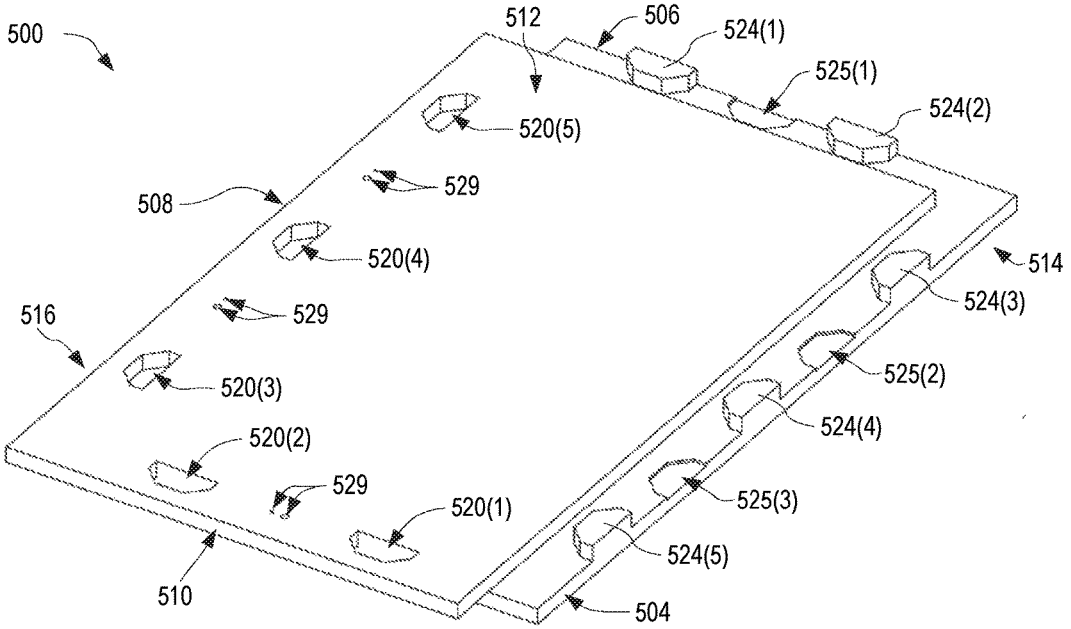
FIG. 62 is a bottom perspective view of the interlocking tile of FIGS. 59, 60 and 61.

FIG. 59 is a top view of one exemplary foam injection molded monolithic interlocking tile 500. FIG. 60 is a bottom view of interlocking tile 500 of FIG. 59. FIG. 61 is a top perspective view of interlocking tile 500 of FIGS. 59 and 60. FIG. 62 is a bottom perspective view of the interlocking tile 500 of FIGS. 59, 60 and 61. In the following description, tile 500 is described as used for forming a floor covering, having an upper surface and a bottom surface relative to the floor. FIGS. 59-62 are best viewed together with the following description.

Tile 500 has a top surface 502 that is substantially rectangular, sides (or edges) 504, 506, 508, and 510, and a bottom surface 512 that is substantially rectangular. It should be appreciated that the shape of top surface may be square. Top surface 502 and bottom surface 512 are offset from one another in the horizontal plane and do not align vertically; however, corresponding edges of the rectangles formed by the top and bottom surfaces 502, 512 are parallel. Top surface 502 and adjacent sides 504 and 506 form an upper lip 514. Bottom surface 512 and sides 508 and 510 form a lower lip 516. Upper lip 514 and lower lip 516 form a common plane that is parallel to and between a plane of the top surface and a plane formed by the bottom surface 512. Upper lip 514 overlaps lower lip(s) 516 of adjacent tiles 500 such that upper surface 502 of adjacent tiles meet to form a substantially continuous surface.

Lower lip 516 is formed with a plurality of apertures 520 and a plurality of recesses 521. In the example of FIGS. 59-62, apertures 520 and recesses 521 are demi-octagonal in shape and similar in size; however, apertures 520 and recesses 521 may have other shapes and sizes without departing from the scope hereof. Lower lip 516 may also include a plurality of washer plates 522 that have a similar shape to recesses 521. In the example of FIGS. 59-62, washer plate 522(1) is positioned within recess 521(1), washer plate 522(2) is positioned within recess 521(2), and washer plate 522(3) is positioned within recess 521(3). More or fewer recesses 521 and washer plates 522 may be used without departing from the scope hereof.

Figure 64:
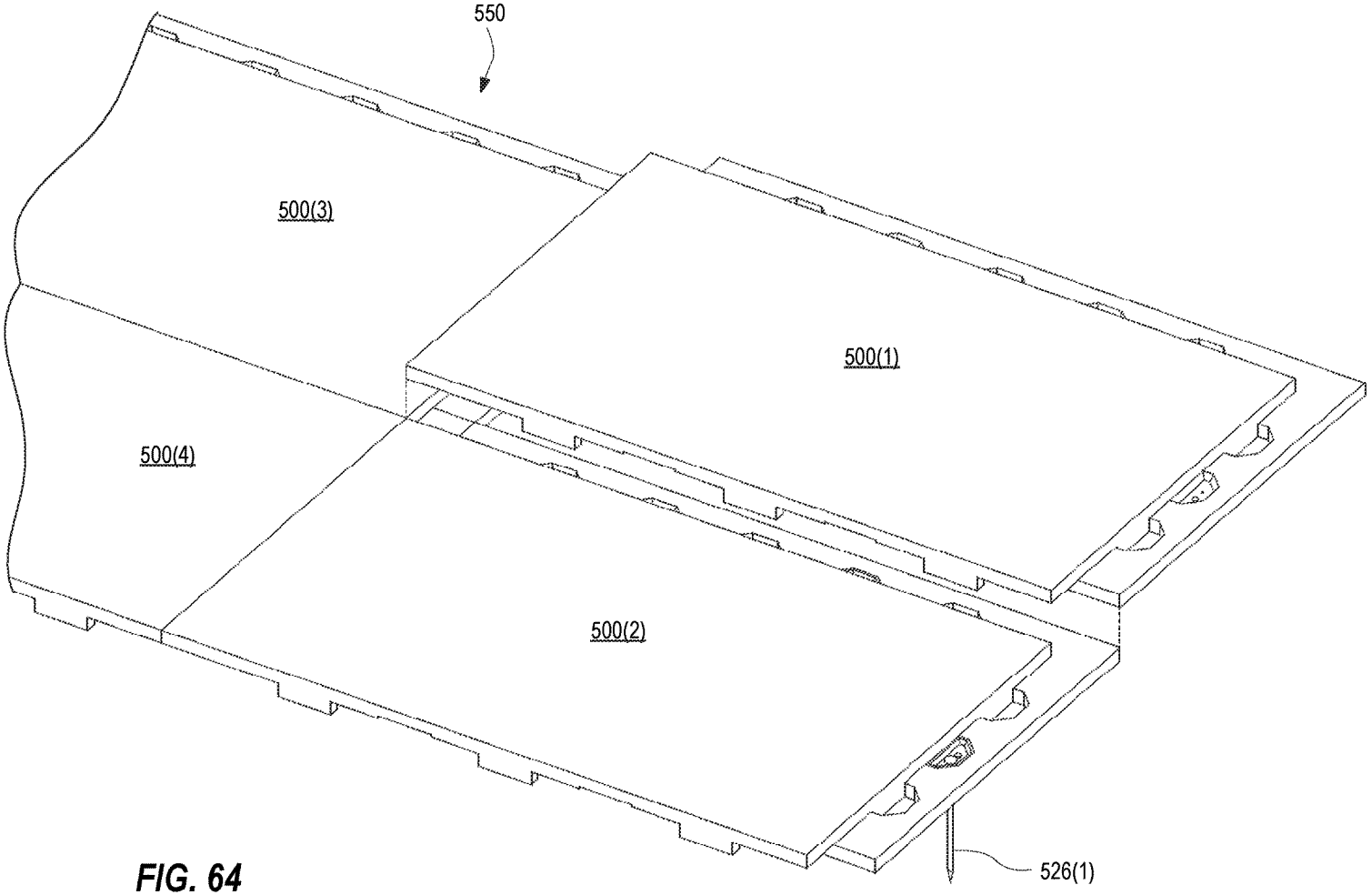
FIG. 64 shows exemplary interlocking of the tiles of FIGS. 60-63.

Upper lip 514 is formed with a plurality of downward protrusions 524 that are positioned, sized and shaped to fit within apertures 520 of adjacent tiles (see FIG. 64). Optionally, in certain embodiments, a plurality of indentations 525 are positioned, sized, and shaped to align with corresponding recesses 521 and washer plates 522 of adjacent tiles 500 (see FIG. 64).

Figure 63:
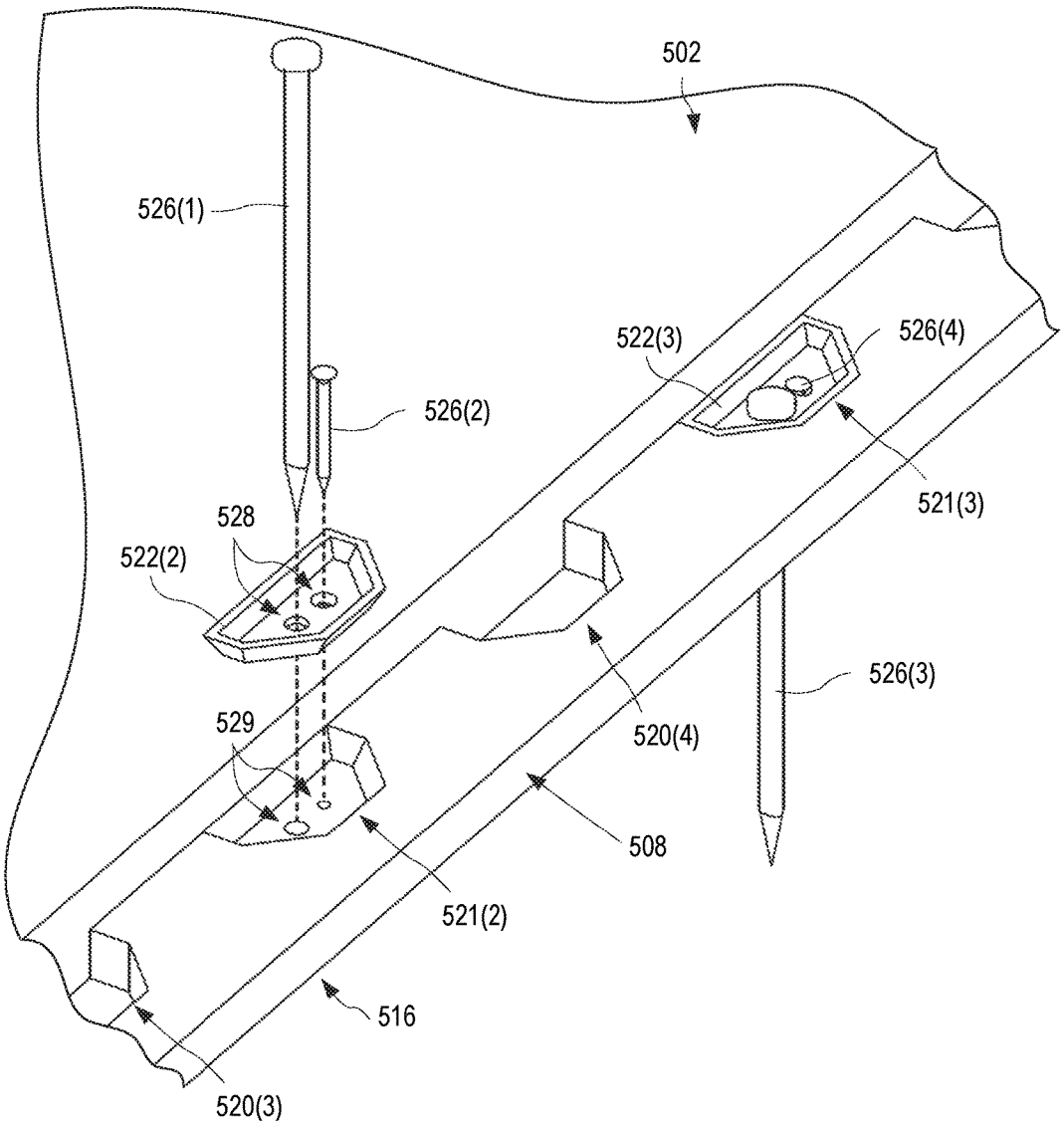
FIG. 63 is a perspective view of the tile of FIGS. 59-62 illustrating the securing features in further exemplary detail.

FIG. 63 is a perspective view of the tile of FIGS. 59-62 illustrating the securing features of recesses 521 and washer plates 522 in further exemplary detail. Each washer plate 522 has one or more washer plate holes 528 that align with holes 529 within one recess 521 when washer plate 522 is inserted therein. As shown in FIGS. 59-62, holes 529 may be located within recess 521; in other words, holes 529 are smaller in diameter or width than recess 521. In one embodiment, washer plate 522 is formed of a stronger material than tile 500 to facilitate securing of tile 500 to an underlying structure using one or more fasteners 526 through holes 528/529. Washer plate 522 prevents fasteners 526 from easily pulling through tile 500. Fasteners 526 may be selected from the group including nail(s), screw(s), staple(s), stake(s), and other similar fastenings.

FIG. 64 shows exemplary interlocking of four tiles 500 of FIGS. 60-63. Tiles 500(2)-(4) are already secured in place (e.g., using fasteners 526), and tile 500(1) is positioned to interlock with both tile 500(2) and tile 500(3). Specifically, protrusions 524(1)-(2) of tile 500(1) mate with apertures 520(1)-(2) of tile 500(3) and protrusions 524(3)-(5) of tile 500(1) mate with apertures 520(3)-(5) of tile 500(2), respectively. Tile 500(1) may then be secured in position using one or more fasteners 526 as needed. Additional tiles 500 may then be interlocked with tiles 500(1)-(3) such that a platform 550 of upper surfaces 502 of tiles 500(1)-(4) is of a desired size.

The lapped joints formed between tiles 500 by upper lip 514 and lower lip 516 discourage movement of tiles 500 when interlocked. For even greater stability, optional washer plates 522 and optional fasteners 526 (selected based upon the nature of the supporting structure) may be used to better secure each tile 500 in position.

Manufacture

Tile 500 is monolithic and formed by injection molding of a closed-cell foam material, such as expanded polypropylene (EPP). The foam material is compacted along the interior surfaces of the mold to provide a puncture and water-resistant exterior surface of tile 500. In one embodiment, tile 500 is one and a half inches thick and allows for the capacity to span small gaps between substructure support such as pallets, sandbags, and other materials.

Tile 500 may also be manufactured by injection molding a molten material, such as plastic, into a mold and allowing the material to set. Tile 500 may also be made by heat forming, vacuum forming, by rotocasting or rotationally molding, by shaping and compressing a malleable material such as water-resistant paper (e.g., cardboard) or by casting or welding metal forms. In one embodiment, till 500 is formed of wire-mesh reinforced cement. However, any method of manufacture that yields a tile as disclosed herein may be used to form tile 500.

Where tiles 500 are formed of a foam material, tile 500 is easily cut to a desired shape and size to form a covering or platform 550 of any shape and size. Foam, a substantial proportion of which is trapped gas, is extremely light and therefore tiles 500 are easily transported either by vehicle or manual labor. Tile 500, when made of the foam material, may be made to a density that is comfortable to sit/lie on while providing also provides thermal and noise insulation.

Top surface 502 and/or bottom surface 512 of tile 500 may be formed with texture (e.g., provided by one or more of extrusions, indentations, bumps, grooves, and other features that increase the coefficient of frictions of the surface), for example during molding or forming of tile 500, or a non-skid treatment may be applied to one or both of surfaces 502/512 after tile 500 is formed. Non-skid treatments include, but are not limited to, a textured or high-friction spray coating, an adhesive sheet or sheets, a surface treatment to roughen one or both of surfaces 502/512 and a raised or recessed pattern formed within top surface 502, for example via injection molding, via structural foam injection molding, during thermoforming (e.g., vacuum forming), or during rotocasting or rotational molding. Peripheral sides 504, 506, 508, 510 and mating surfaces of upper and lower lips 514, 516 may be left un-treated to facilitate joining of tiles 500.

In one embodiment, washer plates 522 are formed by injection molding a plastic material. These washer plates 522 may also be formed via metal stamping, 3d printing, and laser cutting. Washer plate holes 528 may be enlarged or otherwise modified to accommodate fasteners of a different shapes and sizes.

Although illustrated forming a floor covering, tile 500 may also be used to form coverings for walls, ceilings, and roofs, as described above for pallet caps 100 and pallets 300.

While the present disclosure generally discusses multipurpose pallet caps, shipping pallets and monolithic interlocking tiles, and manners in which multiple pallets/caps/tiles may be assembled to produce secure crates, expandable flooring and shelter systems, it is to be appreciated that various types of fastening mechanisms and configurations of pallets/caps/tiles may be used to achieve alternate forms. In addition, features disclosed in reference to one of pallets, caps, and tiles may be incorporated into others of the pallets, caps, and tiles without departing from the scope hereof. In particular, pallet caps disclosed herein may be interconnected to form a secure crate, a stair step structure or other geometric configurations as described above with respect to shipping pallets, and via extensions, notches and fasteners disclosed with respect to shipping pallets, and vice versa. Furthermore, changes and modifications may be made to the structures and methods disclosed herein without departing from the spirit and scope of this invention.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. An interlocking tile, comprising:

a monolithic structure having:

a first surface, a second surface opposite the first surface and offset from the first surface in a horizontal plane parallel to the first and second surfaces, the first surface including a first lip located at two adjacent sides of the structure with a plurality of shaped protrusions, and the second surface including a second lip located at two other adjacent sides of the structure and forming a plurality of shaped apertures matching in number and shape with the plurality of protrusions; and a recess formed in the second lip and forming a hole for receiving a fastener to secure the monolithic structure to a supporting structure.

2. The interlocking tile of claim 1, the recess shaped and sized to receive a washer plate forming at least one washer plate hole aligned with the hole of the recess, for strengthening the tile when secured by the fastener.

3. The interlocking tile of claim 2, the washer plate being formed from injected molded plastic.

4. The interlocking tile of claim 2, the structure comprising a first material and the washer plate comprising a second material stronger than the first material.

5. The interlocking tile of claim 1, the monolithic structure being formed of an injected molded foam material.

6. The interlocking tile of claim 5, the foam material being expanded polypropylene (EPP).

7. The interlocking tile of claim 5, the foam material providing one or both of thermal and noise insulation.

8. The interlocking tile of claim 1, the protrusions being demi-octagonal in shape.

9. The interlocking tile of claim 1, wherein the shaped protrusions do not protrude past a plane formed by the second surface.

10. The interlocking tile of claim 1, the plurality of shaped apertures being positioned such that the shaped protrusions of an adjacent interlocking tile fit therein when interlocked together.

11. The interlocking tile of claim 1, the first surface and the second surface being 1.5" apart.

12. The interlocking tile of claim 1, the first surface comprising a texture to increase friction.

13. The interlocking tile of claim 1, the monolithic structure being suitable for use as a floor, wall, ceiling, or roof.

14. The interlocking tile of claim 1, surfaces of the first and second lip forming a common plane between and parallel with the first and second surfaces.

15. The interlocking tile of claim 14, the common plane being equidistant from the first and second surfaces.

16. The interlocking tile of claim 14, the plurality of shaped protrusions extending perpendicularly from the common plane to a plane defined by the second surface.

17. The interlocking tile of claim 14, the plurality of shaped apertures spanning the common plane and the second surface.

18. The interlocking tile of claim 1, the first lip including:
a first lip surface, opposite the first surface, and
an indentation extending only partially between the first lip surface and the first surface.

19. Interlocking tile covering, comprising:
a first monolithic structure having:
a first surface,
a second surface opposite the first surface and offset from the first surface in a horizontal plane parallel to the first and second surfaces,
the first surface including a first lip located at two adjacent sides of the first structure with a first plurality of shaped protrusions, and
the second surface including a second lip located at two other adjacent sides of the first structure and forming a first plurality of shaped apertures matching in number and shape with the first plurality of protrusions; and
a first recess formed in the second lip and forming a first hole for receiving a first fastener to secure the first monolithic structure to a supporting structure; and
a second monolithic structure having:
a third surface,
a fourth surface opposite the third surface and offset from the third surface in a horizontal plane parallel to the first and second surfaces,
the third surface including a third lip located at two adjacent sides of the second structure with a second plurality of shaped protrusions, and
the fourth surface including a fourth lip located at two other adjacent sides of the second structure and forming a second plurality of shaped apertures matching in number and shape with the second plurality of protrusions; and
a second recess formed in the fourth lip and forming a second hole for receiving a second fastener to secure the second monolithic structure to the supporting structure;
wherein each of the second plurality of protrusions mates with a corresponding one of the first plurality of shaped apertures.

20. An interlocking tile, comprising:
a monolithic structure having:
a first surface,
a second surface offset and opposite the first,
the first surface including a first lip located at two adjacent sides of the structure with a plurality of shaped protrusions, and
the second surface including a second lip located at two other adjacent sides of the structure and forming a plurality of shaped apertures matching in number and shape with the plurality of protrusions; and
a recess formed in the second lip and forming a hole for receiving a fastener to secure the monolithic structure to a supporting structure;
the recess shaped and sized to receive a washer plate forming at least one washer plate hole aligned with the hole of the recess, for strengthening the tile when secured by the fastener.

21. An interlocking tile, comprising:
a monolithic structure having:
a first surface,
a second surface offset and opposite the first,
the first surface including a first lip located at two adjacent sides of the structure with a plurality of shaped protrusions, and
the second surface including a second lip located at two other adjacent sides of the structure and forming a plurality of shaped apertures matching in number and shape with the plurality of protrusions; and
a recess formed in the second lip and forming a hole for receiving a fastener to secure the monolithic structure to a supporting structure;
the first lip including:
a first lip surface, opposite the first surface, and
an indentation extending only partially between the first lip surface and the first surface.

22. An interlocking tile, comprising:
a monolithic structure having:
a first surface,
a second surface offset and opposite the first,
the first surface including a first lip located at two adjacent sides of the structure with a plurality of shaped protrusions, and
the second surface including a second lip located at two other adjacent sides of the structure and forming a plurality of shaped apertures matching in number and shape with the plurality of protrusions; and
a recess formed in the second lip and forming a hole for receiving a fastener to secure the monolithic structure to a supporting structure;
the recess shaped and sized to receive a washer plate forming at least one washer plate hole aligned with the hole of the recess, for strengthening the tile when secured by the fastener;
the structure comprising a first material and the washer plate comprising a second material stronger than the first material.

* * * * *